US009984525B2

(12) United States Patent
Will et al.

(10) Patent No.: US 9,984,525 B2
(45) Date of Patent: May 29, 2018

(54) AUTOMATED VENDING INVENTORY MANAGEMENT APPARATUSES AND METHOD

(71) Applicant: The Hillman Group, Inc., Cincinnati, OH (US)

(72) Inventors: Gary Edward Will, Gold Canyon, AZ (US); Brian Rosner, Phoenix, AZ (US); Bryan Keith Solace, Chandler, AZ (US)

(73) Assignee: The Hillman Group, Inc., Cincinnati, OH (US)

( * ) Notice: Subject to any disclaimer, the term of this patent is extended or adjusted under 35 U.S.C. 154(b) by 378 days.

(21) Appl. No.: 14/261,221

(22) Filed: Apr. 24, 2014

(65) Prior Publication Data

US 2015/0310694 A1 Oct. 29, 2015

(51) Int. Cl.

| | |
|---|---|
| ***G07F 11/44*** | (2006.01) |
| ***G07F 11/16*** | (2006.01) |
| ***G07F 9/02*** | (2006.01) |

(52) U.S. Cl.

CPC ..... *G07F 11/165* (2013.01); *G07F 9/023* (2013.01); *G07F 9/026* (2013.01); *G07F 11/44* (2013.01)

(58) Field of Classification Search

CPC ..... A47F 1/00; G09F 11/00; G07F 11/00

See application file for complete search history.

(56) References Cited

U.S. PATENT DOCUMENTS

| | | | |
|---|---|---|---|
| 4,412,292 | A | 10/1983 | Sedam et al. |
| 4,873,643 | A | 10/1989 | Powell et al. |
| 5,513,116 | A | 4/1996 | Buckley et al. |
| 5,559,714 | A | 9/1996 | Banks et al. |
| 5,615,123 | A | 3/1997 | Davidson et al. |
| 5,710,887 | A | 1/1998 | Chelliah et al. |

(Continued)

FOREIGN PATENT DOCUMENTS

| | | |
|---|---|---|
| WO | WO 95/05609 A2 | 2/1995 |
| WO | WO 99/48065 A1 | 9/1999 |
| WO | WO 99/50801 A2 | 10/1999 |

OTHER PUBLICATIONS

Edwards, "Vending Machines Go Cellular," *Las Vegas Review-Journal*, Oct. 13, 1996, pp. 1F-2F, Las Vegas, NV, USA.

(Continued)

*Primary Examiner* — Timothy Waggoner

*Assistant Examiner* — Ayodeji Ojofeitimi

(74) *Attorney, Agent, or Firm* — Finnegan, Henderson, Farabow, Garrett & Dunner LLP

(57) ABSTRACT

Apparatuses and methods for managing inventory within a vending apparatus are disclosed. The vending apparatus includes a robot, which is configured to include a camera or a sensor. The vending apparatus contains one or more storage containers filled with items for sale, and the one or more storage containers may include indicia that are readable by the robot and provide information to outside parties. The robot is configured to monitor the items for sale within the vending apparatus, as well as the level of inventory within each storage container. The vending apparatus may transmit information relating to its included items for sale to an external server, where maintenance and refreshment operations can be implemented in an efficient, cost-effective manner.

22 Claims, 17 Drawing Sheets

(56) References Cited

U.S. PATENT DOCUMENTS 5,822,423 A 10/1998 Jehnert et al.
5,931,341 A * 8/1999 Bittermann ..... B65B 7/2807 221/222
6,038,491 A 3/2000 McGarry et al.
6,085,126 A 7/2000 Mellgren, III et al.
6,339,731 B1 1/2002 Morris et al.
6,505,095 B1 1/2003 Kolls
6,535,294 B1 3/2003 Arledge, Jr. et al.
6,587,839 B1 7/2003 McIntyre et al.
6,594,642 B1 7/2003 Lemchen
6,606,602 B1 8/2003 Kolls
6,718,237 B1 4/2004 Murray et al.
6,786,341 B2 * 9/2004 Stinnett ..... A47F 1/08 211/194
6,915,273 B1 7/2005 Parulski
6,941,276 B2 9/2005 Haeberli
6,957,125 B1 10/2005 Rifkin
7,167,892 B2 1/2007 Defosse et al.
7,218,991 B2 5/2007 Walker et al.
7,327,267 B2 * 2/2008 Tsunoda ..... G07F 11/165 340/5.9
7,337,130 B2 2/2008 Ito et al.
7,428,806 B2 * 9/2008 Kim ..... B65B 5/103 221/125
7,428,972 B2 * 9/2008 Warner ..... A47F 5/0823 211/59.1
7,497,352 B2 * 3/2009 Segiet et al. ..... 221/150 A
7,593,897 B1 9/2009 Kolls
7,857,161 B2 * 12/2010 Pinney et al. ..... 221/10
7,880,599 B2 2/2011 Murray et al.
8,024,231 B2 9/2011 Taratino et al.
8,060,247 B2 11/2011 Kaplan et al.
8,191,779 B2 6/2012 Illingworth et al.
8,214,247 B2 7/2012 Murray et al.
8,253,549 B2 8/2012 Murray et al.
8,265,605 B2 9/2012 Marett et al.
8,373,558 B2 2/2013 Sagady et al.
8,392,279 B2 3/2013 Reichhart
8,398,041 B2 * 3/2013 Brinkdopke ..... F16B 45/02 248/316.1
8,509,944 B1 8/2013 Kranyec
8,561,994 B1 * 10/2013 Jeong ..... G07F 11/165 273/451
8,626,614 B2 1/2014 Barber et al.
9,070,261 B2 * 6/2015 Hardy
2001/0049636 A1 12/2001 Hudda et al.
2001/0051876 A1 12/2001 Seigel et al.
2002/0040374 A1 4/2002 Kent
2002/0186402 A1 12/2002 Jackson et al.
2003/0033054 A1 * 2/2003 Yamazaki ..... 700/236
2003/0086123 A1 5/2003 Torrens-Burton
2003/0140017 A1 7/2003 Patton et al.
2004/0165218 A1 8/2004 Fredlund et al.
2004/0172325 A1 9/2004 Blanco et al.
2005/0043011 A1 2/2005 Murray et al.
2005/0182649 A1 8/2005 Parulski
2006/0031128 A1 2/2006 Lamitie
2006/0097001 A1 * 5/2006 Yuyama et al. ..... 221/130
2007/0021866 A1 * 1/2007 Coppola ..... G07F 11/04 700/231
2007/0136125 A1 6/2007 Godwin et al.
2007/0164554 A1 7/2007 Krone et al.
2007/0273513 A1 * 11/2007 White ..... 340/568.8
2008/0179326 A1 * 7/2008 Krauth et al. ..... 220/260
2008/0249657 A1 10/2008 Wendland et al.
2010/0277758 A1 11/2010 Reichhart
2012/0067917 A1 * 3/2012 Obitts et al. ..... 221/2
2013/0036018 A1 2/2013 Dickerson
2014/0108188 A1 4/2014 Comstock et al.

OTHER PUBLICATIONS

Lopez de Ipina et al., "GPRS-based Real-Time Remote Control of MicroBots with M2M Capabilities," *The Fourth International Workshop on Wireless Information Systems*, May 2005, pp. 42-51, Miami, FL, USA.

Cherkassky et al., "The E-volution of Wireless Vending," *Beverage World*, Feb. 15, 2000, 13 pages.

Kasavana et al., "Kiosk technology will give vending new capabilities," *Automatic Merchandiser*, Dec. 1, 2007, 7 pages.

First Office Action dated Dec. 13, 2016, issued in Mexican Application No. MX/a/2014/009024, filed Jul. 24, 2014 (2 pages).

* cited by examiner

FIG. 3A
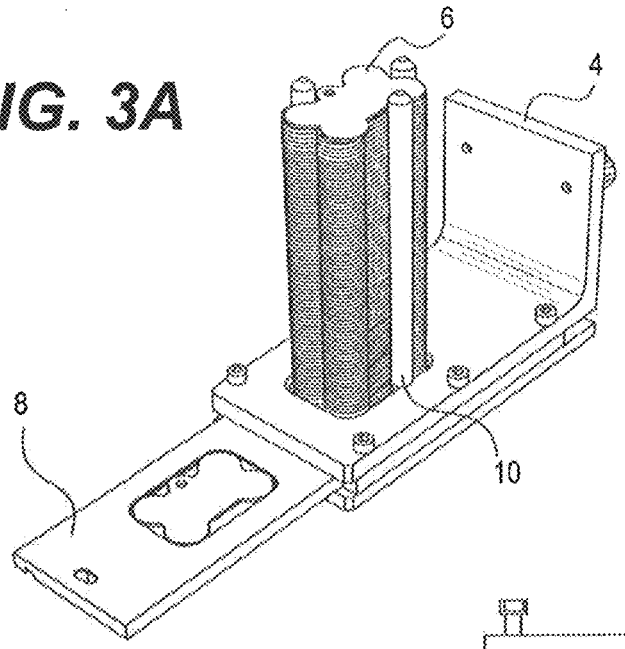
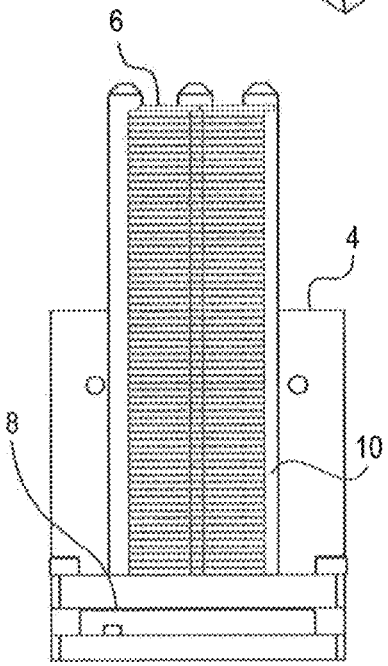
FIG. 3B
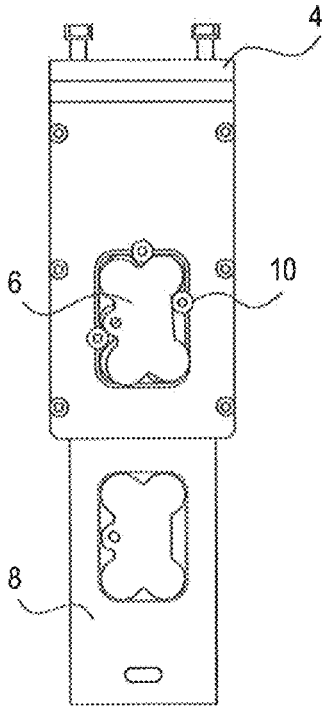
FIG. 3C

AUTOMATED VENDING INVENTORY MANAGEMENT APPARATUSES AND METHOD

FIELD

The present disclosure generally relates to vending machines in a retail environment, and more particularly, to automated apparatuses and methods for managing inventory within a vending machine.

BACKGROUND

Vending machines have been present in the marketplace for decades, but as technology in the vending field and in electronics in general has evolved, vending machines are increasingly shilling from items of mere convenience to central aspects of business strategy. In many ways, a modern vending machine can now come close to fully replacing a brick-and-mortar retail establishment.

Several features are desirable in a modern, integrated vending apparatus designed for a retail environment. Expediting and streamlining the vending process would increase efficiency, quality, repeatability, and profitability. One means of speeding up vending is by automating functions of the vending process traditionally performed manually. This goal may be achieved by implementing an inventory management apparatus that includes a robot and various computerized elements to monitor the items for sale within the vending apparatus. Another desirable feature is to emphasize interchangeable parts within the vending apparatus, such that different items for sale may be added and subtracted quickly. By minimizing the number of physical visits that a human must make to assess the status of the vending apparatus, costs of implementing and maintaining the vending apparatus may be substantially streamlined.

One attempt at an automated inventory system in a vending environment is described in U.S. Pat. No. 6,695,166 (the '166 patent) issued to Long on Feb. 24, 2004. In particular, the '166 patent discloses a vending machine containing one or more racks of stacked products. One or more of the racks within the machine includes an array of capacitive switches that are aligned with the height of the stacked products on the rack. A controller senses the height of stacked products on the rack based on signals sent by the array of capacitive switches. Systems and methods disclosed in the '166 patent may enable the controller to correlate the height of the products to a discrete inventory count for the product, and may transmit the count to a remote device.

Although the systems and methods disclosed in the '166 patent may assist with managing the inventory of a vending machine, the disclosed system is limited. The '166 system would not be readily adaptable to multiple types of products, as an array of capacitive switches that fits one product well may have to be completely redeployed and reprogrammed for different types of products. Further, information communicated from the vending machine to the remote device is limited only to the number of products in each rack of the vending machine. The '166 system contains significant efficiency limitations that would not make it ideal for a merchant seeking to market products to consumers in a sophisticated vending apparatus.

The disclosed system is directed to overcoming one or more of the problems set forth above and/or elsewhere in the prior art.

SUMMARY

The present invention is directed to automated apparatuses and methods for managing inventory within a vending machine. The advantages and purposes of the invention will be set forth in part in the description which follows, and in part will be apparent from the description, or may be learned by practice of the invention. The advantages and purposes of the invention will be realized and attained by the elements and combinations particularly pointed out in the appended claims.

In accordance with one aspect of the invention, an apparatus for displaying products for sale is disclosed. The apparatus comprises a wall with a plurality of holes drilled through it at predetermined intervals. The apparatus further comprises one or more storage containers configured to store a plurality of products, wherein the one or more storage containers further comprise two or more pins configured to hold the products in place, and wherein the one or more storage containers are marked with one or more indicia readable by at least one of a sensor or camera associated with a robot. Additionally, the apparatus includes fasteners sufficient to secure the one or more storage containers to the wall through the drilled holes.

In another aspect, the invention is directed to a vending apparatus for facilitating sale of products in a retail environment. The apparatus comprises a wall with a plurality of holes drilled through it at predetermined intervals. The apparatus further comprises one or more storage containers configured to store a plurality of products, and a robot comprising at least one of a camera or a sensor, wherein the one or more storage containers are marked with one or more indicia readable by the at least one camera or sensor associated with the robot. Additionally, the apparatus includes a delivery opening configured to provide a product to the user. The apparatus also includes a housing substantially enclosing the wall, one or more storage containers, and robot. Finally, the apparatus comprises a user interface device configured to facilitate payment by a consumer for a product stored within a storage container within the vending apparatus.

In yet another aspect, a method for managing inventory within a vending apparatus is disclosed. The method comprises placing one or more storage containers containing a predetermined number of one or more types of items for sale within the vending apparatus. The method further comprises configuring one or more indicia associated with each of the one or more storage containers readable by a camera or sensor associated with a robot. The method includes determining an initial position of the predetermined number of items for sale within each of the one or more storage containers. The method also includes associating the determined initial positions with the configured indicia associated with each of the one or more storage containers. The method further comprises reading, by the camera or sensor associated with the robot, each of the configured indicia associated with each of the one or more storage containers. Also, the method includes determining, by the camera or sensor associated with the robot, an updated position of the items for sale within each of the one or more storage containers. Finally, the method comprises transmitting information relating to the vending apparatus to a remote server.

Additional objects and advantages of the invention will be set forth in part in the description which follows, and in part will be apparent from the description, or may be learned by practice of the embodiments. The objects and advantages of the invention will be realized and attained by the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate various embodiments and aspects of the disclosed embodiments and, together with the description, serve to explain the principles of the disclosed embodiments. In the drawings:

FIGS. 3A-3C are perspective, front, and top views respectively of a product storage container incorporated within a vending apparatus, consistent with disclosed embodiments;

DETAILED DESCRIPTION

Reference will now be made in detail to various embodiments, examples of which are illustrated in the accompanying drawings. Wherever possible, the same reference numbers will be used throughout the drawings to refer to the same or like parts.

Figure 1B:
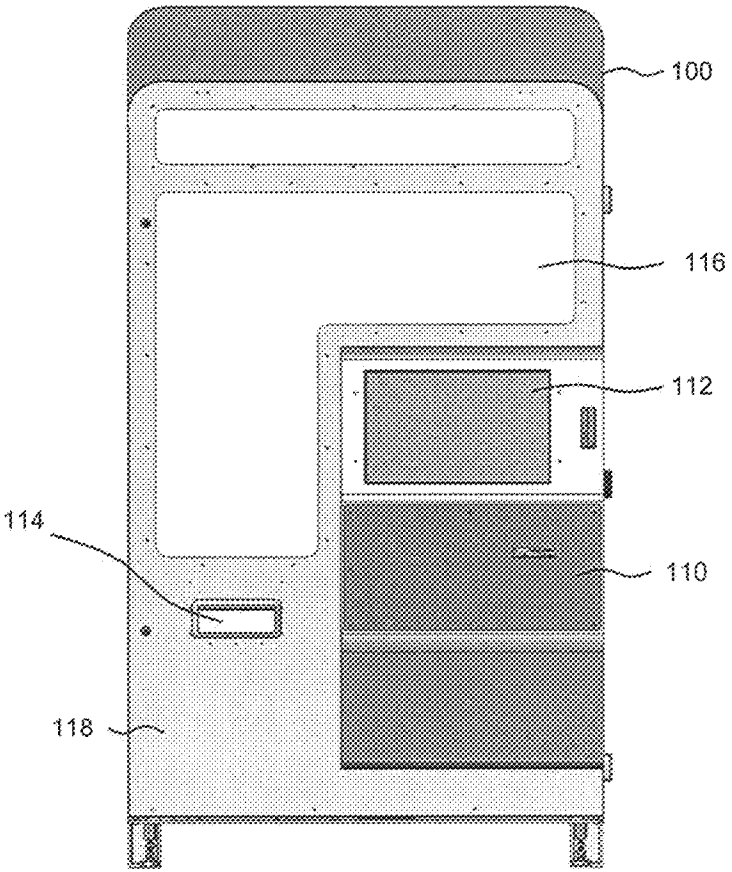
FIG. 1B is a front view of the vending machine of FIG. 1A.
Figure 1A:
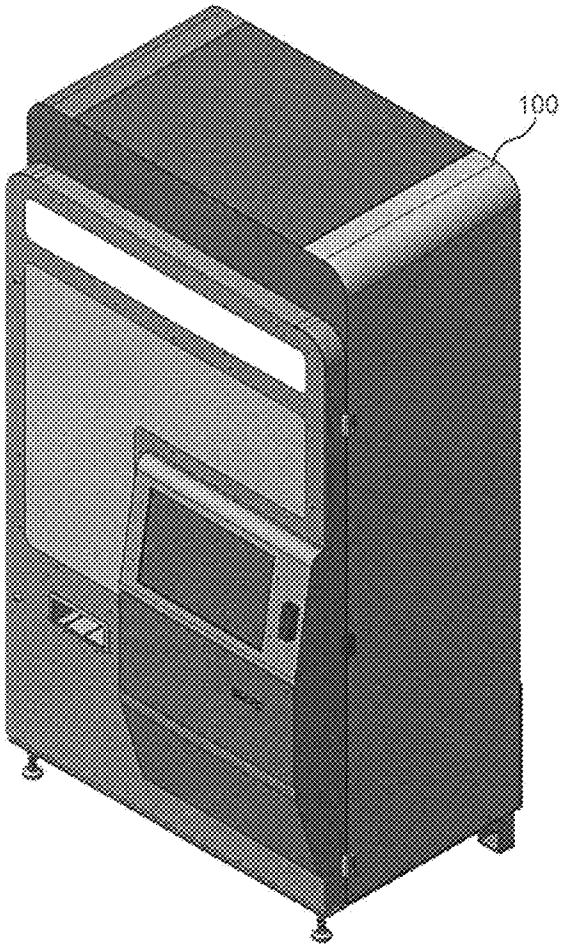
FIG. 1A is an exterior profile view of an exemplary vending apparatus, consistent with disclosed embodiments.

FIGS. 1A and 1B illustrate a vending apparatus consistent with disclosed embodiments. FIG. 1A is a profile view of this vending apparatus 100, and FIG. 1B is a front view. In this vending embodiment, items for sale such as products and accessories for those products may be situated within housing 118. In some embodiments, these products and/or accessories may be maintained within one or more storage containers, which will be described in detail below.

Vending apparatus 100 may include a user interface device 110. User interface device 110 may be configured with various capabilities to facilitate the various functions of a vending machine. User interface device 110 may include a variety of components to control other components of apparatus 100. Device 110 may contain a computing system (not shown), which may further comprise one or more processors and one or more internal memory devices. The one or more processors may be associated with control elements of apparatus 100 that position and operate the various components. The memory devices may store programs and instructions, or may contain databases. The memory devices may further store software relating to a graphical user interface, which device 110 may display to the user on an output screen. The computer system of user interface device 110 may also include one or more additional components that provide communications to other entities or systems via known methods, such as telephonic means or computing systems, including the Internet.

User interface device 110 may include input and output components to enable information associated with the sale of vending items to be provided to a user, and also for the user to input required information. In some embodiments, the input components may include a physical or virtual keyboard. Device 110 may be further configured to receive user-provided content or information in various ways, including but not limited to receiving insertion of flash memory or a USB drive, connecting via a USB or Firewire® cable, receiving files by email, receiving files uploaded via a mobile application, retrieving user-submitted files from an online library or website, etc. In some embodiments, user interface device 110 may be configured to transmit or receive information from a mobile application associated with one or more of a manufacturer of the vending apparatus, a retailer hosting the vending apparatus, or a third party. In these embodiments, vending apparatus 100 and the mobile application may be configured to exchange information relating to the consumer and/or a vending task associated with the user. The information may comprise one or more of information associated with a product the consumer wishes to purchase, information associated with a file submitted to the machine by the user, information associated with payment for the product, or information comprising a location of the nearest vending apparatus. In some embodiments, vending apparatus 100 may be configured to receive a fully pre-paid, pre-configured order for a vending task from the mobile application. In these embodiments, vending apparatus 100 may receive the order directly from the mobile application via user interface device 110 (for example, if a particular vending apparatus 100 is determined to be the closest geographically to the consumer). In other embodiments, user interface device 110 may be configured to access a remote server to retrieve information relating to the order from the mobile application. In these embodiments, vending apparatus 100 may be configured to receive a code configured to facilitate access by user interface device 110 to information associated with a saved transaction ordered from the mobile application.

In some embodiments, device 110 may be capable of outputting audible notifications or alerts to a customer or operator of vending apparatus 100. In such a situation, device 110 may be configured to audibly output, as an example, "PAPER MISFEED" and contact either an on-site or remote customer service representative via audio or visual cues (such as a flashing light) to fix the problem. In another embodiment, device 110 may be configured to tell the user to "LOOK AT THE SCREEN" when information is required from the user or important information is displayed for the user. In yet another embodiment, device 110 may be configured to audibly output "YOUR PRODUCT IS READY" when the desired product and/or accessory have been retrieved from within the vending apparatus 100. In some embodiments, the audio output capabilities of vending apparatus 100 may extend to the input components. Device 110 may include a display screen 112, which may serve as both an input and output device. Device 110 may be configured such that key presses on a virtual keyboard or touchscreen buttons associated with display screen 112 elicit confirmatory clicking noises. Additionally, the input components of device 110, including display screen 112, may be configured to provide tactile or visual feedback to the user to indicate that an input member, such as a key of a keyboard, has been successfully pressed.

In some embodiments, user interface device 110 may include a camera (not shown in FIGS. 1A-1B). The camera, in conjunction with networking capabilities of device 110, may enable a user in another physical location to perform remote diagnostics, maintenance, and calibration of vending apparatus 100, as well as perform customer service functions to assist a user of the apparatus. Device 110 may be configured to transmit the stored consumer image to a remote network server, and may communicate an indication to the consumer information about additional products that might be available for the consumer that can be printed and shipped from a remote location. The indication may be communicated to the consumer through various known means of communication, such as by telephone, email, social media, or on an interact webpage associated with one or more of the consumer, the retail outlet hosting vending apparatus 100, or the maker of vending apparatus 100. In some embodiments, device 110 may provide further options to the user, including customizing and purchasing accessories for the product, or configuring a delivery vehicle for the product. Device 110 may also be configured to prompt the user to select a companion accessory for the purchased product. In some embodiments, the user may be prompted to insert a desired accessory into the machine, or the accessory may be contained within the apparatus. Device 110 may be configured to coordinate and collect payment for the accessory.

Device 110 and an included camera may be configured to allow interaction with vending apparatus 100 by remote operators. Device 110 may be configured to include a "hot button" that when pressed, sends a notification to the remote operator asking for bye video or audio contact with the operator of the apparatus. In some embodiments, a remote technician may be capable of being notified by device 110, and able to view system components live through the camera. Device 110 may be further configured to enable control by the remote technician, who could then perform service on vending apparatus 100 such as clearing jammed receipt paper, removing a stuck product from a storage container, retrieving a dropped accessory, etc. In other embodiments, device 110 and the included camera may enable real-time customer service interactions with a user. When either a customer or an operator such as a store clerk have questions about the process or require assistance, a remote customer service representative may be contacted via device 110's hot button and can interact live with the customer. In some embodiments, device 110 may be configured to facilitate live video chat on an included display screen, such as display screen 112, with the representative. In other embodiments, device 110 may be configured to facilitate live audio interaction with the representative, similar to a telephone call. In yet other embodiments, pressing the hot button may activate a text-based live chat, or send an email to the customer service representative. In some embodiments, the remote customer service may be a value-added service, as the service representative can assist a consumer in purchasing and customizing additional products and/or accessories.

Device 110 may be further configured to coordinate and collect payment for the vending task. The memory of device 110 may contain information relating to pricing for various types of the plurality of products. The pricing may vary by product, and may vary based on other predetermined criteria, such as the quantity of objects desired, processing tasks completed, etc. Device 110 may display the pricing information on an output screen, such as display screen 112, to the user. Device 110 may include, or be connected to, payment acceptance components that can accept cash, credit cards, or other payment methods from the consumer, such as a coupon, or a payment application on a mobile device. These payment acceptance methods may be situated proximal to a product delivery opening 114, as shown in the illustration of FIG. 1B. In these embodiments, device 110 may be configured to prevent access to the purchased product through delivery opening 114 until payment has been received and accepted.

Device 110 may include a printer that can provide the consumer with a receipt of the payment transaction. In some embodiments, the receipt may also contain other information, such as an Internet URL for a website associated with either the retail outlet hosting vending apparatus 100, or the maker of vending apparatus 100 for purposes of additional possible products. Device 110 may be integrated into housing 118, as shown in FIGS. 1A-1B, or it may be disposed as a distinct device proximal to housing 118 but not integrated within it. It should be understood that a device similar to device 110, with any of the above configurations, may be provided as part of any apparatus contemplated by this invention, whether in a vending or retail context or not.

Housing 118 may be configured to include at least one surface portion 116 comprised of a transparent material. The material may comprise, as non-limiting examples, acrylic, glass, fiberglass, plastic, or a hybrid material. Transparent surface portion 116 may be oriented in a manner that makes the components of the automated inventory management system visible to a consumer or other operator while safely shielding the user from heat, pinch points, stored energy sources, and other such potential hazards associated with the operation of heavy machinery. Transparent surface portion 116 may provide entertainment and education to the user while the vending task is underway, and may also allow an operator to take note of components of the apparatus requiring maintenance or repair. In some embodiments, transparent surface portion 116 may facilitate remote diagnostics, maintenance, and user assistance via the configured features of user interface device 110.

As discussed briefly above, vending apparatus 100 may contain one or more mechanisms for holding or storing a supply of product inventory. One such mechanism may be a storage container, with each container containing one type of a plurality of types of products. In other embodiments, one or more of the storage containers within vending apparatus 100 may be configured to store included accessories for products. Examples include, but are not limited to, key rings or key chains, covers or holders for luggage tags, frames, handles, etc. In some configurations, stand-alone accessories may also be contained in a storage container within vending apparatus 100, or may be introduced to the apparatus by a user. Accessories may serve as value-added components that add to the aesthetics or utility of the purchased product. Accessories may or may not be dispensed at the same time as the purchased product. For example, one user may purchase both a product and a matching accessory. Another user might purchase and customize only a product. Finally, another user might purchase and customize a product, and return to vending apparatus 100 at a later time to purchase one or more accompanying accessories for the product. As discussed above, the accessories may be pre-packaged, and inserted into vending apparatus 100 by the user before, during, or after the purchase of the product. Further detail about storage containers and various alternative embodiments therein is provided below in association with FIGS. 2-6.

Vending apparatus 100 may be configured to contain a robotic transport mechanism (not shown). The robotic transport mechanism may comprise a series of rails mounted onto one or more interior walls of housing 118. The mechanism may further comprise a robotic head unit, which is configured to travel along the rails in three dimensions by way of a belt or chain. In some embodiments, the robotic head unit may be operably coupled to a telescoping robotic arm and an end effector. An example embodiment of an end effector will be described in detail below in association with FIGS. 5A-5C.

Consistent, precise operation of the robotic transport mechanism is critical, since it must perform many activities in a compressed spatial area within vending apparatus 100. The robotic transport mechanism may be configured to retrieve a selected product and/or accessory from various storage containers. Further, the robotic transport mechanism may provide the purchased product to delivery opening 114 for the customer to retrieve.

The robotic transport mechanism may be deployed within vending apparatus 100 in a variety of configurations. For example, in some embodiments, the mechanism may comprise a single robotic head unit and end effector, and the rails for movement of the robot may be configured essentially in an "H" shape that primarily allows movement in the X and Y directions. Movement in the vertical Z direction is achieved via a telescoping robotic arm. The robotic arm permits an end effector to fit into tight areas within vending apparatus 100, and permits it to perform precise movements.

In alternative embodiments, these problems may be solved through a different configuration of the robotic transport mechanism. In these embodiments, the robotic transport mechanism may not include a telescoping robotic arm. Instead, the robotic transport mechanism may contain multiple end effectors. The rails may be configured in a manner that permits the robotic head unit and end effectors to essentially cover their own "region" in the Z-plane within vending apparatus 100. Thus, one end effector might be situated higher on the robotic head to access the top half of vending apparatus 100, and might for example be responsible for retrieving products and accessories from storage containers in the top half of vending apparatus 100. Meanwhile, another end effector might be situated lower on the same robotic head to access the bottom half of vending apparatus 100, and might be responsible for all transport activities associated with delivery of purchased products to the user via delivery opening 111. All of these robotic motion operations may be performed in full view of transparent section 116 of housing 118, so that the customer may visualize and enjoy the process of their product's retrieval and/or customization.

Figure 2A:
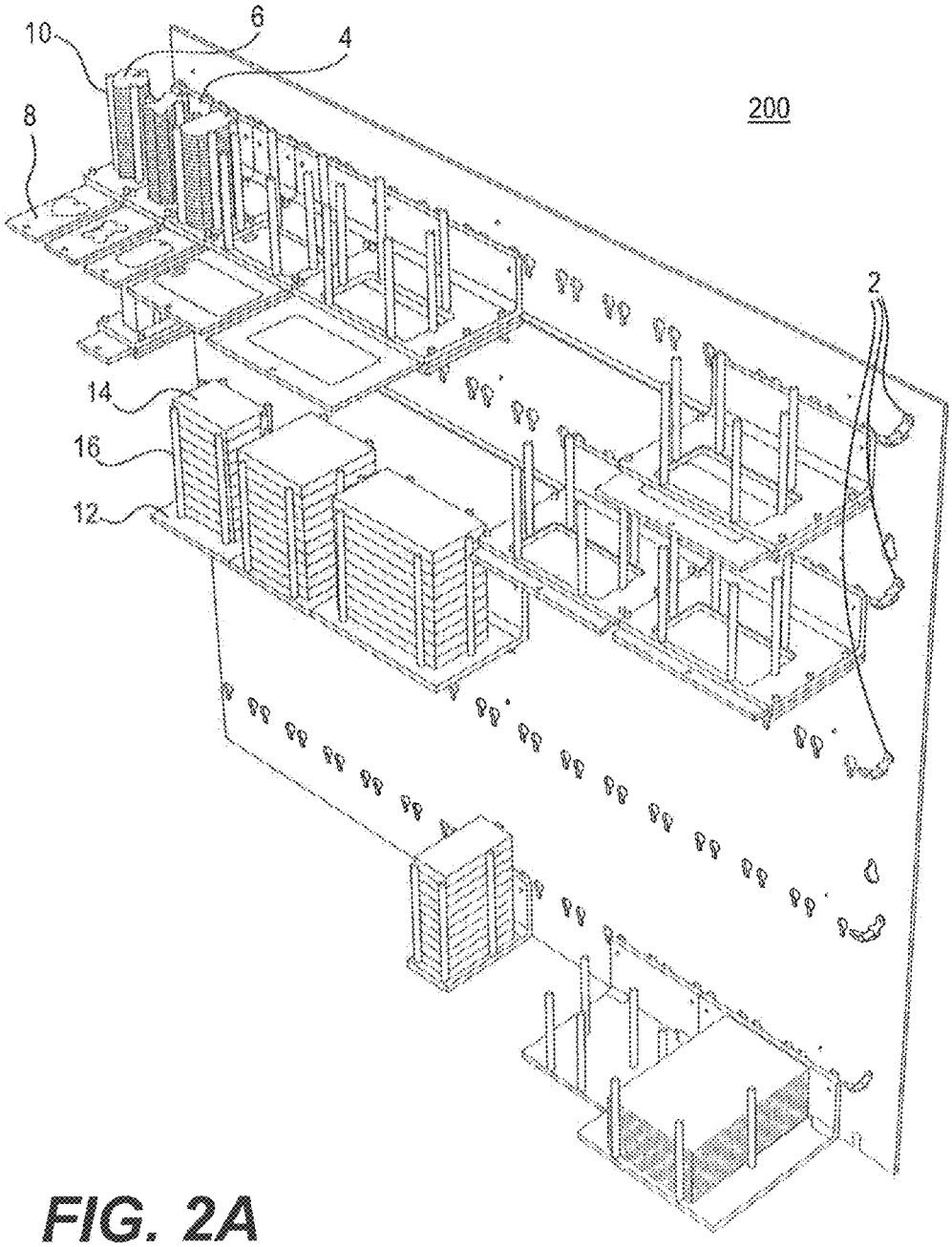
FIGS. 2A-2B are diagrammatic illustrations of an inventory management system and apparatus, consistent with disclosed embodiments.
Figure 2B:
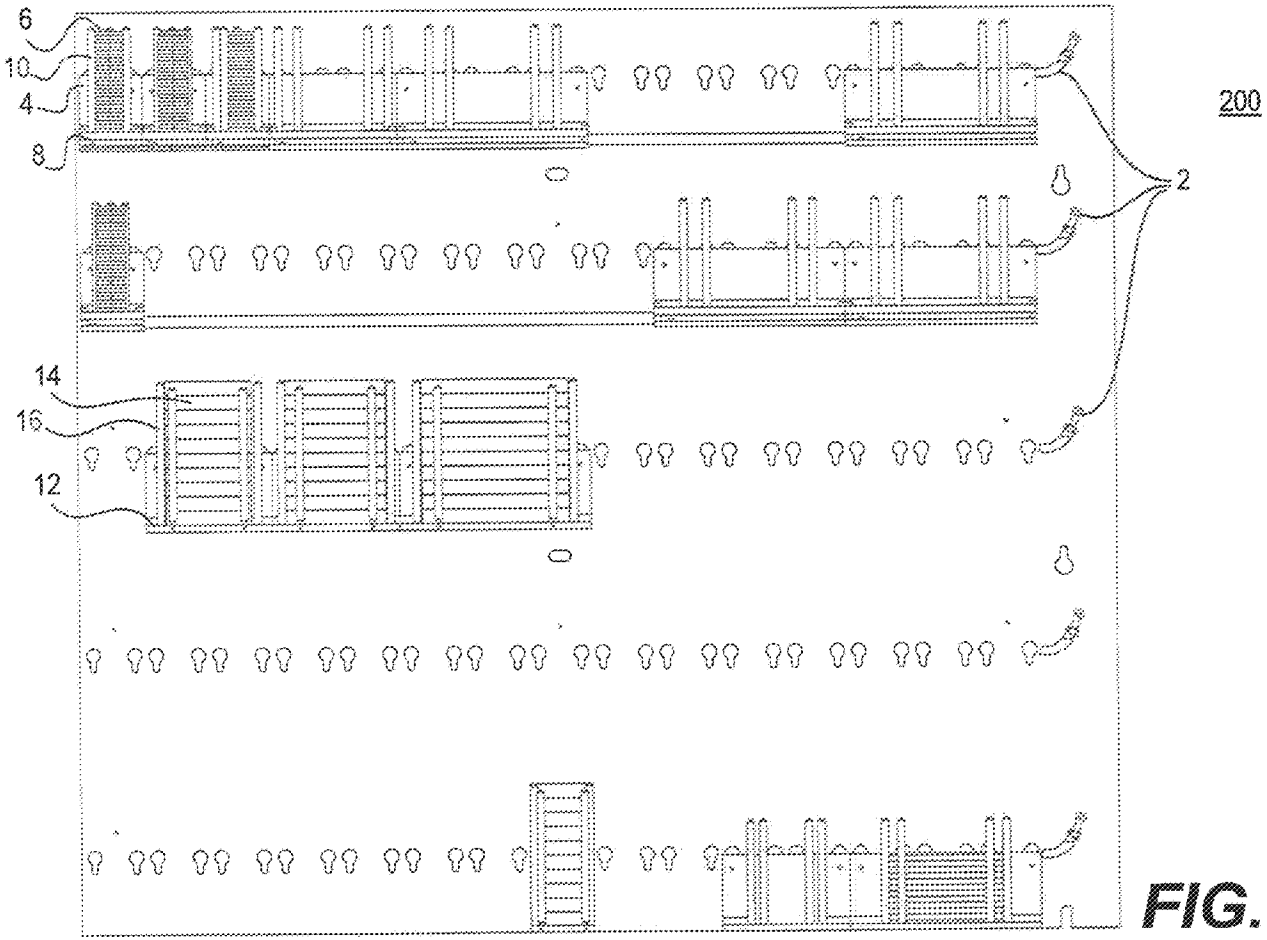

Turning to FIG. 2, FIGS. 2A and 2B illustrate perspective and front views, respectively, of an inventory management and deployment system 200 consistent with disclosed embodiments. In some embodiments, inventory system 200 may be situated within a vending apparatus 100. In alternative embodiments, inventory system 1700 may be configured to be used with a stand-alone apparatus outside of a vending context (not shown) that may be clerk-assisted or user-operated. The back wall of inventory system 200 may be comprised of any suitable material, such as wood, pressboard, cardboard, plastic, acrylic, aluminum, steel, etc. Inventory system 200 may include several locks 2 placed at the end of each row of the system. Each lock 2 may be mechanically coupled to a locking bar (not shown) located on the rear of the back wall of inventory system 200. When rotated, switched, or otherwise engaged, lock 2 engages the locking bar to secure storage containers that may be attached through the hack wall of the inventory system.

As illustrated in FIGS. 2A and 2B, an inventory system 200 may contain one or more product containers 4 and accessory containers 12. Product containers 4 and accessory containers 12 may be configured in a modular manner such that they may be interchangeably installed and removed rapidly within inventory system 200. FIGS. 2A-2B illustrate a series of different containers 4 and 12 that may have different heights, widths, and depths based on the products or accessories that they contain. For example, the illustrated embodiment of FIG. 2A shows various product containers 4 each containing a stack of a plurality of different products 6, such as heart-shaped pet tags, bone-shaped pet tags, luggage tags, military dog tags, and various products related to mobile devices. Each product container 4 includes a shuttle 8, which presents a single product that can be picked up by, for example, an end effector of a robotic transport mechanism as described above. Each shuttle 8 also contains a hole, divot, or other such feature near its end, which can interface with a mechanical implement disposed on such an end effector. Further detail on the interaction between the robotic transport mechanism and a shuttle is described and illustrated below in association with FIGS. 5A-5C. The individual stacks of products 6 are held in place by pins 10. In some embodiments, one or more of the pins 10 associated with each product container 4 may be removable, enabling refreshment of the product stack by a front-loading process that can be readily automated. Alternatively, all pins 10 may be stationary on product container 4 and the products may be refreshed by a top-loading process. Pins 10 may be movable on the surface of product container 4 to account for different shapes and sizes of products 6.

Elsewhere on the top row of the back wall of inventory system 200 is an empty portion of the mounting system for the product containers 4. By using common spacing, product containers 4 (as well as accessory containers 12) may be manufactured with common dimensional units. These common dimensional units may correspond to a predetermined distance between a series of key slots or holes drilled into the back wall. For example, a product container 4 with a thinner width, such as the pet tag containers in the upper left of FIGS. 2A and 2B, may be mountable on a single pair of key slots located on the back wall of inventory system 200, and may be locked into place using locks 2. Wider containers, such as the mobile device product magazines to the right of the pet tag containers, may be mountable on two or three sets of key slots. This common dimensionality allows interchangeability of product containers 4 and accessory containers 12, and permits rapid re-arrangement and re-deployment of different products and accessories within vending apparatus 100. This may assist the retailer hosting vending apparatus 100 to rotate out offerings based on season, location, special events, etc., and enhances the profit generation capabilities of the vending apparatus.

In the example embodiment illustrated in FIGS. 2A and 2B, accessory containers 12 are located on the back wall of inventory system 200 below the product containers 4. Depending on the products 6 offered for sale in a given embodiment of vending apparatus 100, various complementary accessory containers 12 may be deployed within inventory system 200, each containing a stack of a plurality of different accessories 14. In some embodiments, such as the example embodiment illustrated in FIGS. 2A and 2B, accessory containers 12 may not include spring-loaded shuttles 8 in the manner of product containers 4 described above. Further, as also shown in FIGS. 2A and 2B, individual accessories 14 may be packaged and presented in boxes or other such wrapping. Thus, the individual accessories are larger and easier for an end effector of a robotic transport mechanism to grasp, and a shuttle system such as shuttles 8 may not be required for accurate retrieval. In alternative embodiments, the shuttles may be included. Much as is the case for products 6, the individual stacks of accessories 14 are held in place by pins 16. In some embodiments, one or more of the pins 16 associated with each accessory container 12 may be removable, enabling refreshment of the accessory stack by a front-loading process that can be readily automated. Alternatively, all pins 16 may be stationary on accessory container 12 and the products may be refreshed by a top-loading process. Pins 16 may be movable on the surface of accessory container 12 to account for different shapes and sizes of accessories 14.

Turning to FIG. 3, FIGS. 3A-3C are detailed views of a product container 4 as described above. In the example of FIG. 3, product container 4 is filled with a stack of products 6, which here are bone-shaped dog tags, held in place by three pins 10. FIG. 3A is a perspective view of the product container assembly, FIG. 3B is a front view, and FIG. 3C is a top view. A mechanical implement (e.g., a hook, nubbin, or other such feature) on a robotic end effector such as the mechanical implement described above may interface with the hole in each shuttle 8, pull the shuttle open (as further described in association with FIGS. 5A-5C below), and expose a single product 6. One or more suction cups associated with the end effector may then grasp the product 6 with vacuum pressure, lift the product out of shuttle 8, and transport the product 6 to any desired location within vending apparatus 100. In some embodiments, shuttle 8 may be configured to automatically close (such as via a spring-loaded mechanism), and then drop the next product 6 into the shuttle well for a future vending task. In other embodiments, the shuttle 8 may not automatically close, and may be closed by the robotic transport mechanism via interface with a mechanical implement.

As discussed above, in some embodiments, pins 10 may be movable and/or removable with respect to product container 4. In embodiments where pins 10 are stationary, products 6 may be reloaded from the top either manually by a clerk or automatically, by the robotic transport mechanism via the suction cups. In embodiments where pins 10 are removable, particularly the pins proximal to shuttle 8, a stack of products 6 may be loaded into product container 4 from the front. Alternatively, pins 10 and/or product container 4 itself may contain springs or other flexible elements that may allow an end effector to "open" and/or reload the product container 4 without fully removing the pins 10.

Figure 4A:
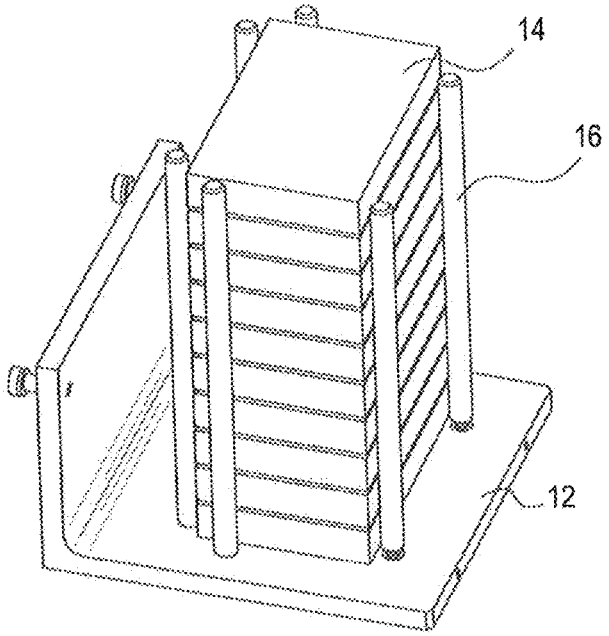
FIGS. 4A-4C are perspective, front, and top views respectively of an accessory storage container incorporated within a vending apparatus, consistent with disclosed embodiments.
Figure 4B:
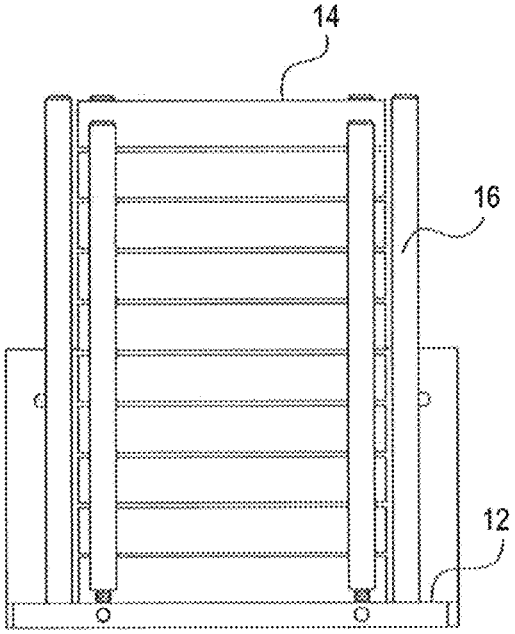
Figure 4C:
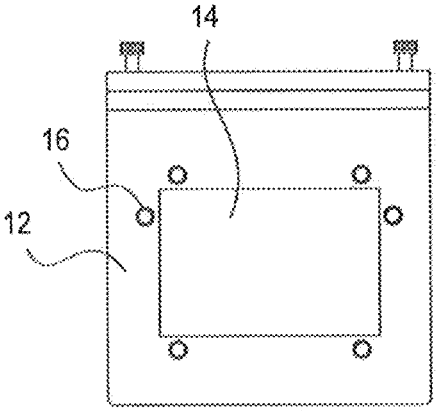

Similar to FIG. 3, FIGS. 4A-4C are detailed views of an accessory container 12 as described above. In the example of FIGS. 4A-4C, accessory container 12 is filled with a stack of boxed accessories 14, held in place by six pins 16, FIG. 4A is a perspective view of the accessory container assembly, FIG. 4B is a front view, and FIG. 4C is a top view. As shown in these figures, the robotic transport mechanism described above may be configured to interface with the accessory container 12. Suction cups associated with a robotic end effector may grasp an individual accessory 14 with vacuum pressure, lift the accessory out of accessory container 12, and transport the accessory 14 to a desired location. In some embodiments, the accessory 14 may be transported directly to an area where it may be accessed by a user, such as delivery opening 114.

As discussed above, in some embodiments, pins 16 may be movable and/or removable with respect to accessory container 12. In embodiments where pins 16 are stationary, accessories 14 may be reloaded from the top either manually by a clerk or automatically, by the robotic transport mechanism via suction cups. In embodiments where pins 16 are removable, a stack of accessories 14 may be loaded into accessory container 12 from the front. Alternatively, pins 16 and/or accessory container 12 itself may contain springs or other flexible elements that may allow an end effector to "open" and/or reload the accessory container 12 without fully removing the pins 16.

Figure 5A:
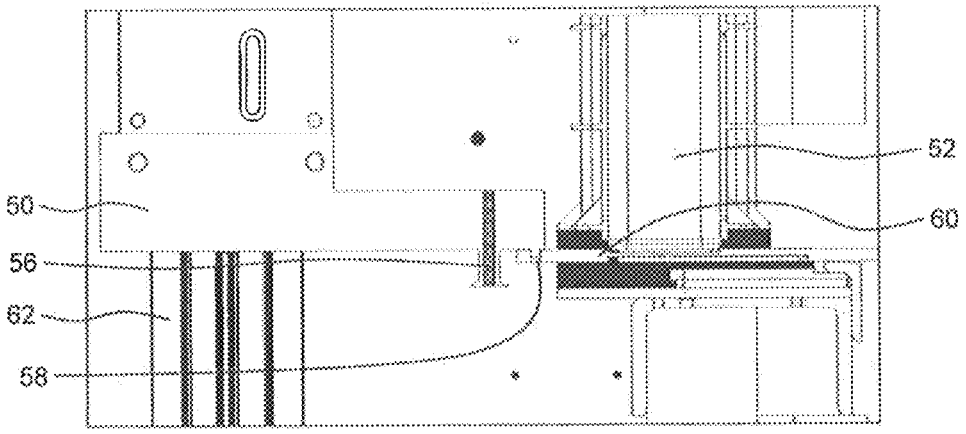
FIGS. 5A-5C are diagrammatic illustrations of an end effector interacting with a storage container incorporated within a vending apparatus, consistent with disclosed embodiments.
Figure 5B:
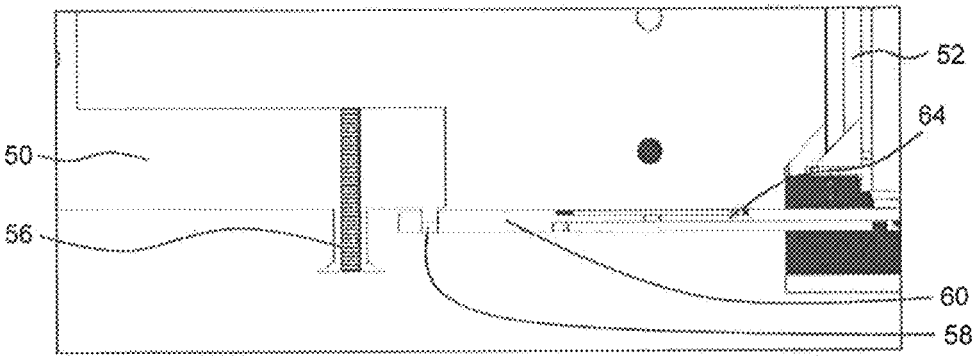
Figure 5C:
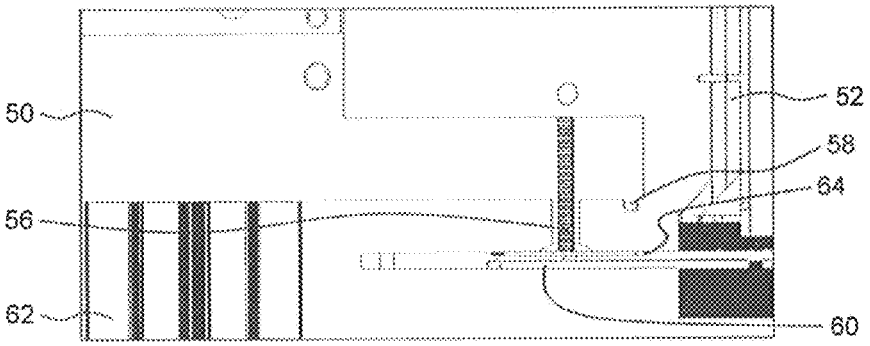

FIGS. 5A-5C illustrate an example end effector 50 in detail, and further illustrate how the robotic transport mechanism may be configured to retrieve products from product storage containers 52 and accessory storage containers 54. As shown in FIG. 5A, end effector 50 contains several implements that help it interact with various components of vending apparatus 100. In some embodiments, end effector 50 may contain one or more vacuum suction cups 56. Suction cups 56 may be arranged in various configurations on the underside of end effector 50. For example, in some embodiments end effector 50 may comprise three suction cups 56, and the suction cups may be arranged in a triangle shape, with two suction cups collinear with one another and the third cup offset from them. In some embodiments, end effector 50 may be linked via cables to an independent vacuum system (not shown). The vacuum system associated with end effector 50 and suction cups 56 may be configured to contain one or more switches or transducers designed to provide feedback to a control (not shown) indicating whether or not the vacuum system is engaged. Each suction cup 56, for example, may have a vacuum switch indicating its engagement status to the control. In these embodiments, for example, end effector 50 may be configured to use two suction cups 56 to pick up a product, such as a luggage tag. If, after retrieving the tag, only one of the suction cups 56 indicates that its suction is engaged, it may indicate a problem, such as an improper pickup of the tag. The control may be configured to stop system activity and, for example, drop the tag that was improperly retrieved and properly retrieve a new tag. In some embodiments, end effector 50 may be configured with two coplanar suction cups 56 situated on the same horizontal plane in order to grab, hold, and transport larger objects, such as boxed accessories 14 or larger products 6 as discussed above. An example end effector 50 will be described in further detail below in association with FIGS. 8A-8C.

End effector 50 may also include a mechanical implement 58 that assists with various functions. In some embodiments, for example, end effector 50 may use mechanical implement 58 to interact with product storage containers 52 and/or accessory storage containers 54 to retrieve products. This process was briefly discussed above in the context of FIGS. 2-4, and will now be discussed in detail. In FIG. 5A, a product storage container 52 may be configured to include a shuttle 60 that acts as a dispenser for products contained within the storage container. In the example illustrated in FIGS. 5A-5C, product storage container 52 contains a plurality of small, flat items such as luggage tags. Shuttle 60 in these embodiments may be configured to contain a well or other small depression in which a single luggage tag may be held for retrieval by the robotic transport mechanism. Within product storage container 52, the stack of other luggage tags may be restrained in some embodiments by a spring-loaded system (not shown), such that engagement and translation of shuttle 60 may dispense exactly one luggage tag.

Shuttle 60 may also contain a hole cut to substantially the same dimensions of mechanical implement 58. Mechanical implement 58 may be configured to fit into this hole in shuttle 60 in order to gain access to products inside of product storage container 52. In FIG. 5A, end effector 50 has moved proximal to product storage container 52, and has engaged shuttle 60 via mechanical implement 58. In FIG. 5B, with implement 58 and shuttle 60 still mechanically coupled to one another, a robotic head unit and/or robotic arm associated with the transport mechanism (not shown) translates end effector 50 away from product storage container 52. This action has the effect of pulling shuttle 60 fully open so that the product 64 held within it can be freely accessed. Finally, in FIG. 4C, the robotic head unit and/or robotic arm first moves end effector 50 upwards, so that mechanical implement 58 disengages with shuttle 60. The robotic head unit and/or robotic arm then may translate end effector 50 towards product storage container 52, such that one or more suction cups 56 are aligned above product 64. The robotic bead unit and/or an associated control (not shown) may energize the vacuum system associated with end effector 50 and suction cups 56. The robotic head unit and/or robotic arm may then move end effector 50 downwards such that the suction cup(s) 56 engage product 64. Once the vacuum switches described above are triggered, indicating that suction cups 56 are secured to product 64, the robotic head unit and/or robotic arm may translate end effector 50 up and away from shuttle 60 and may transport product 64 to another location within vending apparatus 100. In some embodiments, end effector 50 may first re-engage shuttle 60 via mechanical implement 58 and replace shuttle 60 back into product storage container 52. In other embodiments, end effector 50 may return to product storage container 52 after depositing product 64 at its destination, and may then close shuttle 60. In still other embodiments, shuttle 60 may be configured to automatically close once product 64 is removed. Notably, the robotic transport mechanism may perform a similar process to the one just described in association with product storage container 52 to retrieve accessories from an accessory storage container 54 (not shown in FIGS. 5A-5C).

In some embodiments, end effector 50 may be equipped with one or more sensors and a camera that may be configured to interface with a vision system that will be described below in association with FIGS. 6A-6C. Said sensors may be configured to read and recognize indicia on one or more products, accessories, or other integrated components of vending apparatus 100. In some embodiments, end effector 50 may additionally include one or more cameras that may be configured to visually recognize the indicia. In these embodiments, these indicia may constitute fiducial markers, such as those described below in association with FIG. 6B. In other embodiments, the indicia may constitute barcodes, QR codes, or other such machine-readable indicia. In some embodiments, the one or more sensors associated with end effector 50 may be infrared sensors. Alternatively, the sensors may be laser sensors, proximity sensors, or other non-contact sensors. The one or more sensors may be configured to operate as part of an automated inventory management system that will be described in further detail below.

In some embodiments, the one or more sensors may be situated on a side of end effector 50, and may be configured such that each sensor is pointed in a downward direction. In these embodiments, systems associated with vending apparatus 100 may determine inventory levels of products or accessories within the apparatus using the vertical distance traveled by the laser or infrared beam before recognizing an indicia and/or the physical presence of a product or accessory within the magazines or other storage containers. In other embodiments, the one or more sensors may be situated on end effector 50 proximal to mechanical implement 58, and may be configured such that each sensor is pointed in a forward direction. Different configurations of end effector 50 are illustrated and described in detail below in association with FIG. 8. In these embodiments, the vision system may be configured to recognize when the infrared sensor, laser beam, proximity sensor, or other non-contact sensor senses the top of a stack of products or accessories within the storage containers described above, and may use such data to determine the inventory level of the given product or accessory. In alternative embodiments, the one or more sensors may be coextensive with mechanical implement 58, and the inventory system may be configured to recognize tactile contact with the top of the stack of products or accessories (with a contact switch or similar device) to determine the inventory level.

Inventory system 200 may thus be configured to substantially automate the inventory management process for any given individual vending apparatus 100. Deployment of system 200 saves time and resources, particularly when augmented with additional features. In these embodiments, end effector 50 and an associated control (not shown) may be configured to track the inventory levels of the various products 6 and accessories 14 within each product container 4 and accessory container 12, respectively. For example, in one embodiment, upon installation of a given product container 4 or accessory container 12 within the back wall of an inventory system 200, a "home position" for the particular container may be registered by the sensor(s) associated with end effector 50. This home position would in essence be the "top" of the container, and would equate to the container being full. The control may then be configured to know the unit vertical height of each product 6 or accessory 14 within the container. For example, a given accessory container 12 may house boxed luggage tag holders whose boxes are each 0.5" high. End effector 50 may translate within the robotic transport mechanism until it finds the home position for that particular accessory container 12. An associated robotic head may then translate vertically downwards in the Z-direction until the sensor(s) associated with end effector 50 detect the presence of the top of a box. In the example presented above, for example, if the robotic head translates about two inches before detecting a box, the robotic transport mechanism control may determine that four of the 0.5" boxes have been removed from the accessory container 12.

Alternatively, the vertical home position for a given storage container may be the bottom level of the container, where the product quantity is zero, and the product height is represented by $Ph_0$). The one or more sensors associated with end effector 50 may be configured to determine the top level of the stack of products in a container, represented by $Ph_x$. Assuming that the vertical thickness of any single product in that particular storage container is represented by the variable t, then the number of products in that storage container can be calculated by $(Ph_x-Ph_0)/t$.

As configured, inventory system 200 may be configured to automate at least three major functions of the vending apparatus 100 supply chain. First, inventory system 200 enables vending apparatus 100 and associated user interface device 110 to know that a particular product or accessory is out of stock before an attempt is made to retrieve the out-of-stock item from its storage container. As discussed in further detail below in association with FIGS. 9-14, inventory system 200 may be configured to alter the information displayed to a user via the user interface device relating to out-of-stock products. For example, the item may be "grayed out" on the selection interface presented on display screen 112, or may otherwise indicate that the item is not available, and the user may be directed to select another item. In these embodiments, user interface device 110 may be configured to suggest or automatically select an alternative item if inventory is not available. If the desired item is in stock, but at a low inventory level, user interface device 110 may be configured to display other related information. For example, purchase of the item may be limited to an amount less than or equal to the inventory count remaining within the particular storage container, as detected by inventory system 200. In other embodiments, the user interface may be configured to offer a discount on low-stock items, in the manner of a "sale" or "clearance."

A second function of inventory system 200 is that inventory levels can be tracked automatically, and resources can be saved by preventing unnecessary refill trips by a human worker. For example, the robotic transport mechanism control, in conjunction with user interface device 110, may be programmed such that a given inventory level triggers a refill visit. This threshold inventory level may be calculated on the basis of a single product container 4 or accessory container 12 (i.e., "refill me when inventory reaches 20% of full") up to the level of the entire vending apparatus 100 (i.e., "make a service visit when the average inventory level of all containers readies 50%"). User interface device 110 may be configured to send information relating to inventory to a remote server, such as a server associated with the retail establishment hosting apparatus 100, a server associated with the manufacturer of apparatus 100, or another third party server. In some embodiments, the information may be sent regularly on a set schedule, including but not limited to hourly, daily, weekly, monthly, quarterly, semi-annually, or annually. In other embodiments, the information may be sent on an as-needed basis; for example, when one or more of the threshold levels described above are reached. In still other embodiments, a user operating one or more of the remote servers described above may be capable of accessing user interface device 110 or a remote server containing the information, and may affirmatively cheek the inventory status of apparatus 100 and its equipped containers.

As described, inventory system 200 can substantially reduce time and hassle for a human service operator. The embodiments described above remove the necessity for a human operator to disable apparatus 100 and manually count the number of products 6 and/or accessories 14. Further, the refilling process can be expedited further by providing set declinations of refill products 6/accessories 4; for example, a pack of 25 of the boxed luggage tag holder accessories described in the example above. In these embodiments, a human operator may simply wait to refill the particular accessory container 12 for the luggage tag holder accessory until 25 of them have been removed and sold from apparatus 100. In other embodiments, user interface device 110 may be configured to compile an inventory report based on information relating to inventory gathered by inventory system 200, and display it on demand to the human service operator. The report may be displayed, for example, on display screen 112, or printed via an optional receipt printer associated with user interface device 110 described above. In these embodiments, the efficiency of visits to the vending apparatus 100 by a human service operator may be even further increased, by allowing an instant report of what products need to be replaced and/or replenished. The report may also be transmitted from user interface device 110 to a remote server. Inventory system 200 can thus reduce downtime for apparatus 100, minimize hassle to the service operator and the retail establishment, and enhance revenue.

A third function and benefit of inventory system 200 is that it can assist with replenishment and management operations further up the supply chain. For example, a warehouse or other such storage facility affiliated with the human service operator may contain known amounts of products or accessories for deployment in one or more vending apparatuses 100 in a given geographical region. As individual inventory systems 200 in each vending apparatus 100 periodically determine inventory levels of the various products, they may send information to a server as discussed above that prompts action by a human service operator, such as a replenishment visit. The server may be configured to compile information received from multiple vending apparatuses 100, including inventory levels, for purposes of determining inventory needs at the regional level. At a predetermined level of inventory, for example, the server may automatically place an order with a supplier for replenishment of the particular product or accessory. In this manner, multiple points of a supply chain can be automated and processed in a far more efficient and cost-effective manner thanks to the capability of a network of vending apparatuses 100 to self-determine and report their own levels of inventory.

Figure 6B:
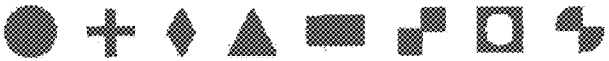
FIGS. 6A-6C are diagrammatic illustrations of fiducial markers and indicia that may be used within an automated inventory management apparatus, consistent with disclosed embodiments.
Figure 6A:
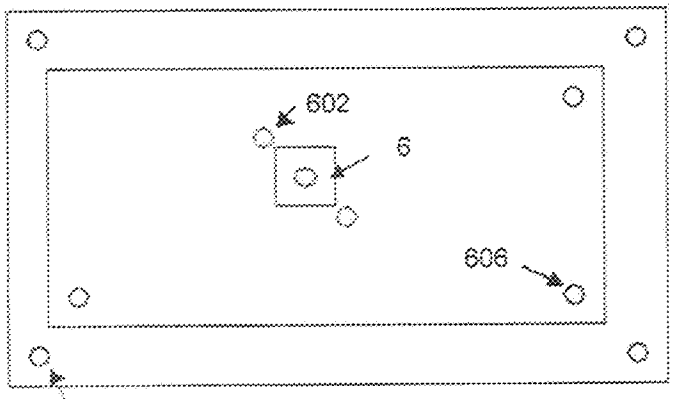
Figure 6C:
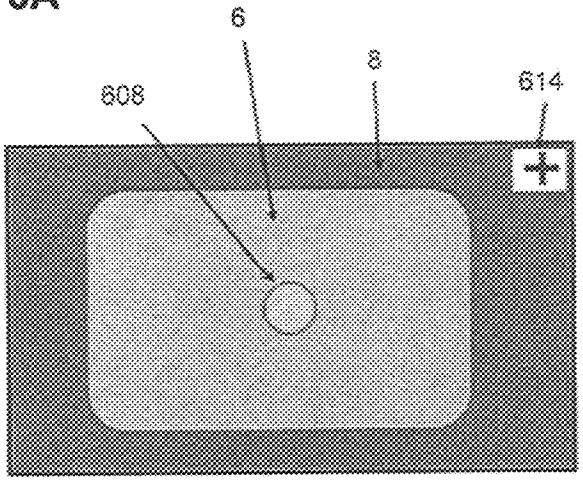

FIGS. 6A-6C describe additional features relating to a camera-aided vision system and fiducial markers described briefly above in detail. FIG. 6A is a diagram illustrating different types of fiducial markers that may be recognizable by the system of sensors and/or cameras described above associated with the robotic transport mechanism, specifically, end effector 50. In the example illustrated in FIG. 6A, a product 6, such as those illustrated in FIGS. 2-3, is situated on a flat platform. The platform may, for example, be situated in vending apparatus 100 and may serve as a staging area for delivery of the purchased product. There are three types of fiducial markers present. A local fiducial marker 602 may be associated with one or more of product 6 or the specific location within apparatus 100. This subtype of fiducial marker may be associated with individual types of products or accessories. A second subtype of fiducial marker illustrated in FIG. 6A is panel fiducial marker 604. In the example illustrated in FIG. 6A, the panel fiducial marker 604 may be permanently disposed on the platform within vending apparatus 100, and may send information to end effector 50 and/or an associated control to assist with proper movements within vending apparatus 100. A third subtype of fiducial marker is a global fiducial marker 606. Global fiducial marker 606 may further assist with alignment or placement of the robotic transport mechanism and/or product 6. Although fiducial markers 602, 604, and 606 are depicted as circles in FIG. 6A, the fiducial markers may be represented as any shape or pattern. Example fiducial markers are shown in FIG. 6B. In some embodiments, it may be advantageous to differentiate the size, shape, color, or other property of different types of fiducial markers, or fiducial markers of the same type associated with different items, such as different types of products 6.

The camera/sensor vision system and fiducial markers as described above may be used in some embodiments to assist an associated robotic transport mechanism within an apparatus 100 to faithfully retrieve products 6 and/or accessories 14 from their respective storage containers. In FIG. 6C, an example embodiment is illustrated in which a shuttle 8 associated with a product container 4 (not shown) is in the open position. A single product 6 (here, illustrated as a luggage tag) is presented to the robotic transport mechanism for retrieval. A local fiducial marker 14 may be disposed on the surface of shuttle 8. Fiducial marker 614 may serve several purposes in the scenario depicted in FIG. 6C, as well as the similar scenario presented in FIGS. 3A-3C and 5A-5C. First, fiducial marker 614 may assist a camera or sensor associated with end effector 50 of the robotic transport mechanism in gauging its global position with respect to the shuttle 8 and the product 6. In other words, the robotic head may be able to adjust the position of end effector 50 in the X, Y, and/or Z directions based on coordinates read from fiducial marker 614. Secondly, fiducial marker 614 may allow for finer scale adjustments once end effector 50 is in range of product 6. For example, end effector 50 may be configured to pick up product 6 at "ideal" location 608 with suction cup(s) 56. Location 608 may be a known lateral distance from fiducial marker 614, and marker 614 may be disposed at a known orientation. If small adjustments in position or alignment are required in order for end effector 50 to grasp product 6 at position 608, information read from fiducial marker 608 interpreted by a control associated with the robotic transport mechanism or user interface device 110 may assist in making the adjustments. Finally, fiducial marker 614 may contain other information specific to the product 6 being presented, such as its size, shape, color, or the material which comprises it. This is intended to be a non-limiting list of possible information, and fiducial marker 614 may contain more or less information in any particular embodiment.

Figure 7:
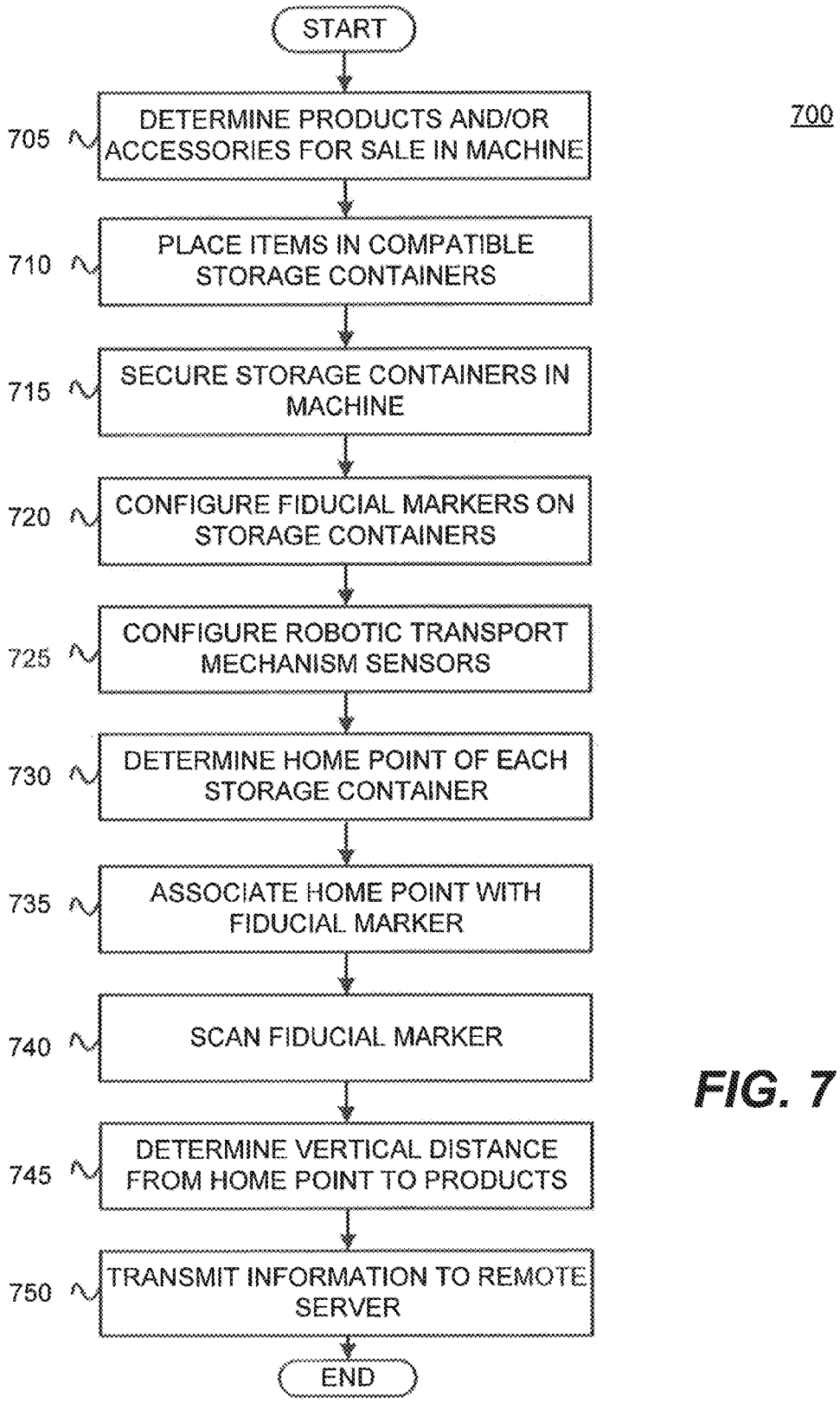
FIG. 7 is a flowchart of an example vending inventory management process, consistent with disclosed embodiments.

Vending apparatus 100 may be configured to perform a vending inventory management process 700, such as that shown in the example of FIG. 7. In one embodiment, a user seeking to deploy a vending machine may determine one or more products and/or accompanying accessories for sale in the vending machine (Step 705). These products and accessories may be substantially the same as products 6 and accessories 14 described above.

As part of the installation of vending apparatus 100, the user may place the determined products 6 and/or accessories 14 in one or more compatible storage containers (Step 710). In the case of products 6, the storage containers may be substantially the same as product storage containers 4 described above. For embodiments including accessories 14, the accessories 14 may be placed in storage containers that are substantially the same as accessory storage containers 12 described above. In some embodiments, the storage containers may be further configured to be compatible with elements of vending apparatus 100. For example, the storage containers may be of a predetermined size based on predetermined spacing between holes cut on the back wall of the vending machine for purposes of displaying the storage containers.

The user may secure the storage containers within vending apparatus 100 (Step 715). As discussed briefly above, storage containers such as product storage containers 4 and accessory storage containers 12 may be installed within inventory system 200 of vending apparatus 100 in a variety of arrangements based on the desired presentation. The storage containers 4 and 12 may be securely locked in place within inventory system 200 using locks 2, which interface with a bar on the rear side of the back wall of the system.

In some embodiments, the user may configure one or more fiducial markers on or near the one or more storage containers 4/12 located within vending apparatus 100 (Step 720). As discussed above, one or more fiducial markers or other indicia may be affixed to each of the one or more storage containers to facilitate communication of information regarding the storage container. In some embodiments, the storage containers may be manufactured with the fiducial markers already included on them. In other embodiments, the fiducial markers may be affixed to the storage containers before deployment within vending apparatus 100. The fiducial markers are readable by a camera or sensor associated with a robotic transport mechanism such as the one described above. The fiducial markers may comprise any type of machine-readable marker, code, or indicia as described above in association with FIGS. 6A-6C, including barcodes, QR codes, and the like.

Process 700 continues by configuring the camera or sensor associated with the robotic transport mechanism (Step 725). As described above, one or more storage containers within vending apparatus 100 may be associated with fiducial markers that are readable by the camera or sensor. In some embodiments, the camera or sensor may be affixed to an end effector, such as end effector 50. In other embodiments, the camera or sensor may be located elsewhere on the robot. When present, sensors associated with the robot may be either infrared or laser sensors, and these sensors may be calibrated and focused prior to deployment within vending apparatus 100.

Via the robotic transport mechanism, vending apparatus 100 may determine a "home point," or initial position, of the products 6 or accessories 12 contained within each of the one or more storage containers (Step 730). The initial position may be determined individually for each storage container, and such a position may be newly determined each time a new storage container is introduced to vending apparatus 100. The initial position may be determined using the camera or sensors associated with the robotic transport mechanism. The position may be determined by any means, such as a predetermined coordinate system, by GPS, by measuring relative distances from the sides, top, or bottom of vending apparatus 100, or by measuring distances from other landmarks. Once determined, a control and/or computer system associated with the robotic transport mechanism may associate the determined initial position with the fiducial marker or indicia associated with that particular storage container (Step 735).

As desired, the robotic transport mechanism may monitor the inventory of the storage containers located within vending apparatus 100. This monitoring may occur on a predetermined time schedule, for example, on an hourly, daily, weekly, monthly, quarterly, semi-annual, or annual basis. In other embodiments, the monitoring for one or more of the storage containers may occur after each purchase transaction processed by vending apparatus 100 for the particular storage container. Alternatively, a remote operator may have the robotic transport mechanism monitor storage container inventory on demand at any time. First, via equipped cameras and/or sensors, the robotic transport mechanism may scan or read the fiducial markers associated with one or more of the storage containers located within vending apparatus 100 (Step 740). As discussed above, information associated with the fiducial marker may include, but not be limited to, the size of each of the one or more storage containers, the type of item for sale contained within each of the storage containers, the current price of the items for sale, the determined initial position of the predetermined number of items for sale within each of the storage containers, the number of items for sale contained within each of the storage containers, the maximum capacity of each of the storage containers, or an entity associated with the items for sale or the vending apparatus. The control or computer system associated with the robotic transport mechanism may store and analyze said information as part of the inventory monitoring process.

After scanning the fiducial markers, the robotic transport mechanism may determine an updated position of the of the products 6 or accessories 12 contained within each of the one or more storage containers by determining a vertical distance from the initial position to a surface of the products or accessories (Step 745). In some embodiments, this process may include activating the camera or sensor, and aligning the camera or sensor with the previously determined initial position of a particular one of the one or more storage containers. Vending apparatus 100 may translate the robot until the camera or sensor detects the top surface (or other such visible indicator) of the "top" item within the container. Upon such detection, vending apparatus 100 may store information relating to the detected updated position of the items for sale, and may calculate the inventory level of the items within the storage container by factoring in a known thickness, height, or other such dimension of the given item. In some embodiments, these known dimensions may be included, within the information read from the fiducial markers in Step 740. As part of the calculation, vending apparatus 100 may be configured to determine a number of items for sale remaining within the storage container, or alternatively, a number of items recently restocked within the storage container.

Via interface device 110, vending apparatus 100 may transmit information relating to inventory management to a remote server (Step 750). The remote server may be associated with one or more of a manufacturer of the vending apparatus, a retailer hosting the vending apparatus, or a third party. The information sent may include any of the information described above that may be contained within the fiducial markers of each storage container, and may further comprise the determined updated position of items within the container and associated inventory level. Responsive to the transmission of the information to the remote server, one or more persons associated with the manufacturer of the vending apparatus, or a retailer hosting the vending apparatus may be dispatched to the location of the vending apparatus to refill one or more of the storage containers with a predetermined number of items for sale.

Figure 8A:
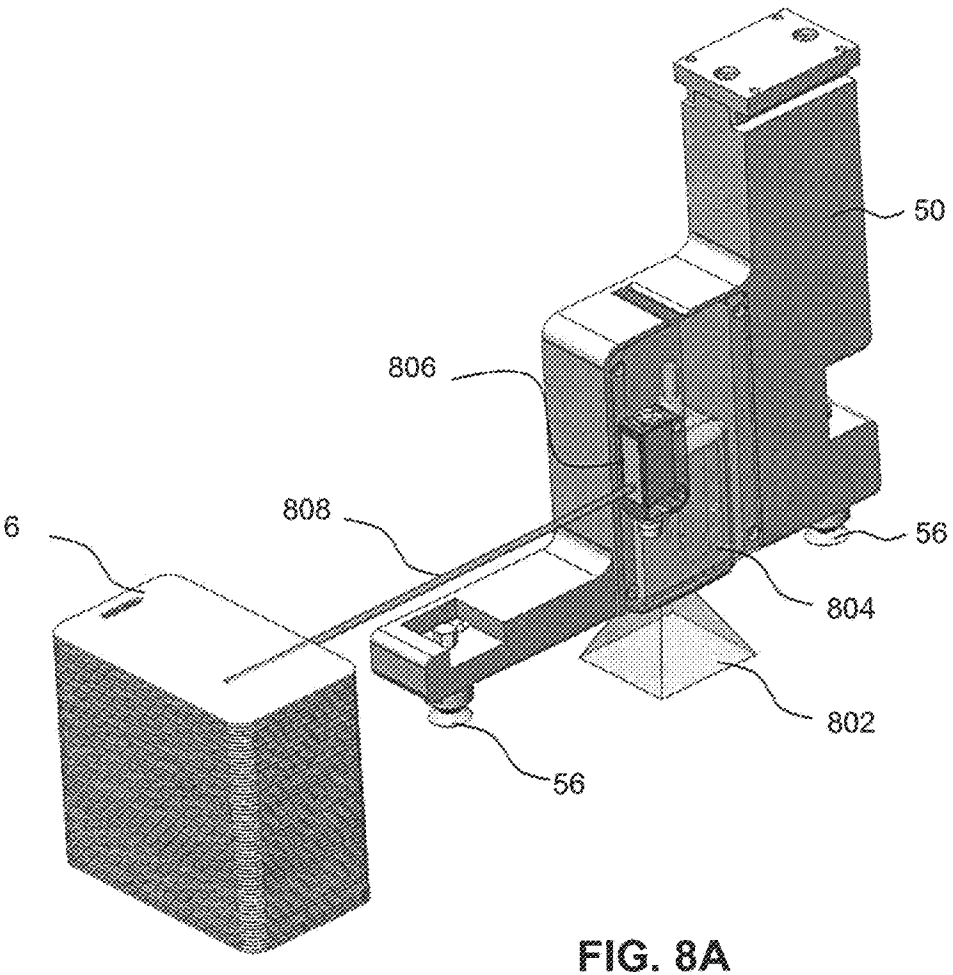
FIGS. 8A-8C are diagrammatic illustrations of an example end effector associated with a robotic transport mechanism, consistent with disclosed embodiments.

Turning to FIG. 8, FIGS. 8A-8C are detailed diagrammatic illustrations of an example end effector 50 equipped with added camera and sensor features as described above. In FIG. 8A, an end effector 50 is shown interacting with a stack of products 6 in an embodiment involving inventory system 200 as described previously. The end effector 50 illustrated in FIG. 8A is equipped with a camera 804 and a sensor 806. Each of these optional devices provides end effector 50 and associated systems described above with additional capabilities. Camera 804, when associated with an end effector 50, may be configured to recognize, detect, and/or read fiducial markers, barcodes, or any other such machine-readable information within field of view 802. The machine-readable information may include fiducial markers such as those described above in association with FIGS. 6A-6C. For example, end effector 50 may be positioned by a robotic control (not shown) such that a fiducial marker associated with a particular storage container within vending apparatus 100 is within field of view 802. Camera 804 may visualize the fiducial marker and read its information, such as information related to inventory count, and then end effector 50 may transmit the information to the control, to user interface device 110, or any other related system within or outside of vending apparatus 100. Camera 804 and field of view 802 may also be configured as discussed previously for other functions related to end effector 50, such as registration in the X and Y directions, and for fine motor control. For example, end effector 50 may pick up a single product 6 using suction cups 56 as described above in association with FIGS. 5A-5C. Camera 804 may use various fiducial markers as described in association with FIGS. 6A-6C to assist in precise retrieval of product 6 and delivery to another location within vending apparatus 100. In the example of FIG. 8A, end effector 50 also includes a sensor 806 configured to operate within an inventory management system 200 as discussed above. In the example of FIG. 8A, sensor 806 may be configured to allow an associated control and/or computer system (not shown) to calculate the height of a stack of products 6 via laser beam 808 for purposes of determining inventory levels of that product. The example illustrated in FIG. 8A is intended to be non-limiting, and other configurations of end effector 50 are contemplated by the disclosed embodiments. For example, sensor 806 may utilize infrared technology instead of a laser beam 808. In other embodiments, sensor 806 may be a contact sensor that can physically detect the height of products 6 within a storage container by touch. In these embodiments, sensor 806 may be associated with or may be coextensive with a mechanical implement 58 included with end effector 50 (not shown in FIGS. 8A-8B).

Figure 8B:
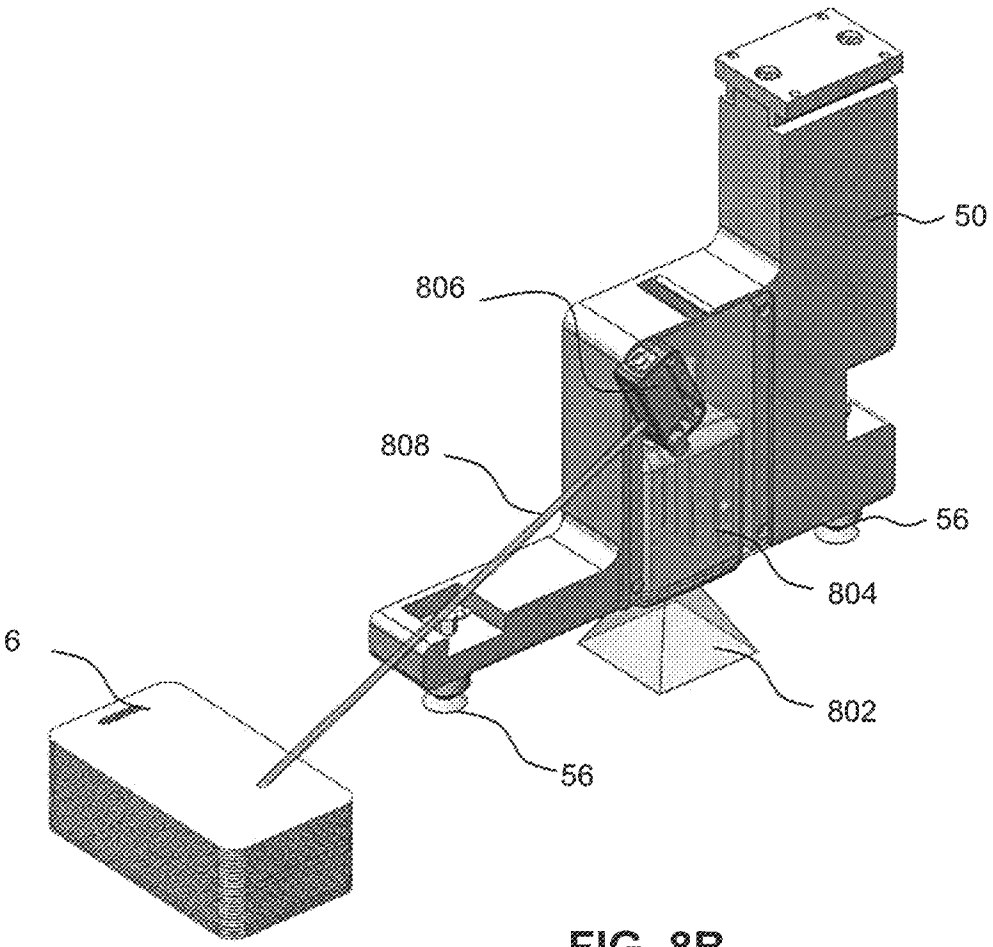
Figure 8C:
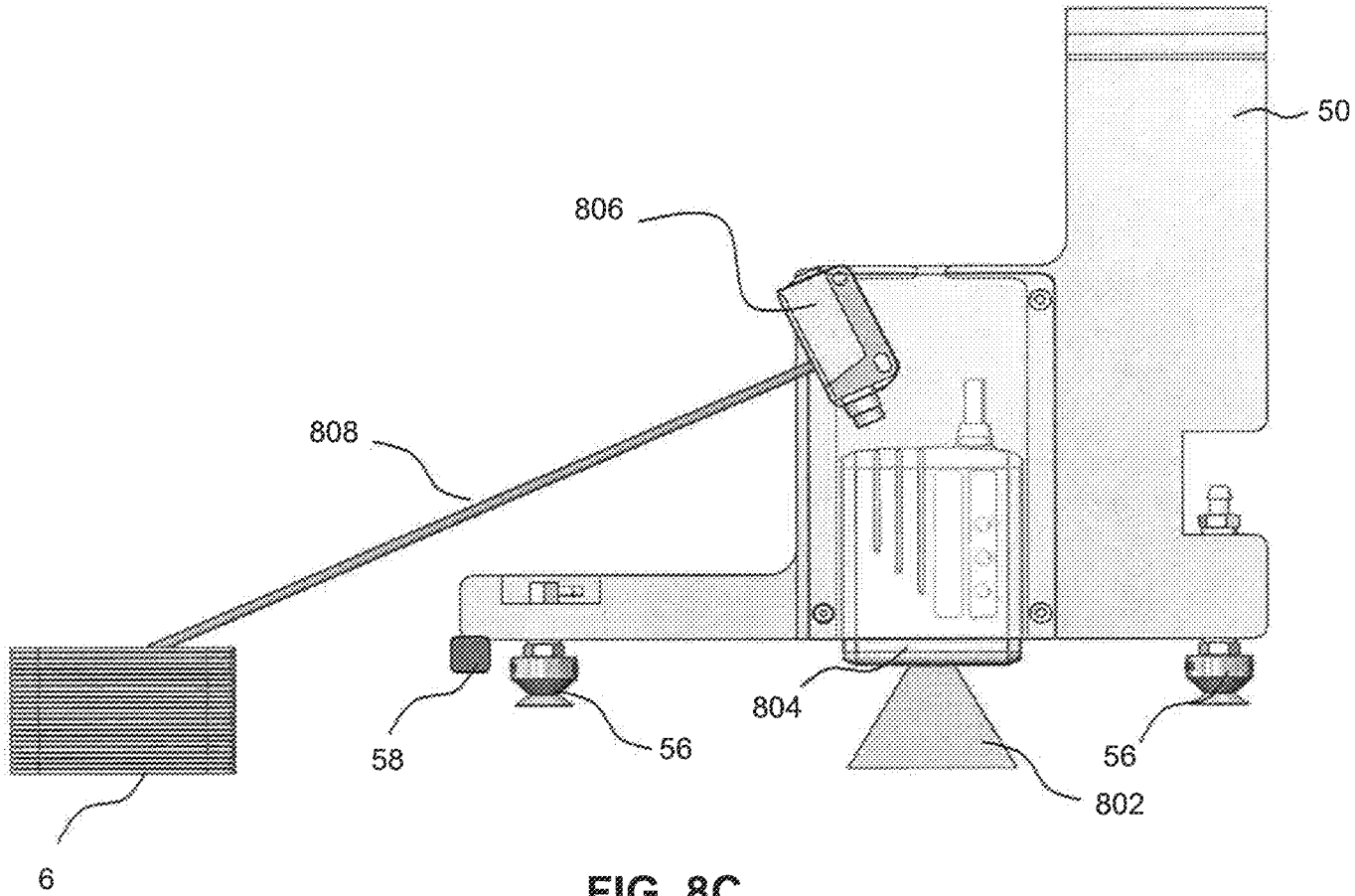

FIG. 8B illustrates an alternative embodiment of FIG. 8A. In FIG. 8B, sensor 806 is mounted at a slightly higher physical location on end effector 50, and is additionally mounted at an angle instead of parallel to the base of end effector 50. In these embodiments, laser beam 808 (or other such technology, as discussed above) may be configured to detect contact a location on the top of a stack of products 6, rather than an edge as shown in FIG. 8A. FIG. 8C is a side view of FIG. 8B. FIG. 8C additionally includes a mechanical implement 58, which may be disposed near the front of end effector 50 as shown to interface with a shuttle 8 or shuttle 60 of a storage container as described previously in association with FIGS. 3A-3C and 5A-5C. In addition, mechanical implement 58 may be configured as discussed above to serve as a contact sensor for use in determining inventory levels within an inventory management system 200.

Figure 9:
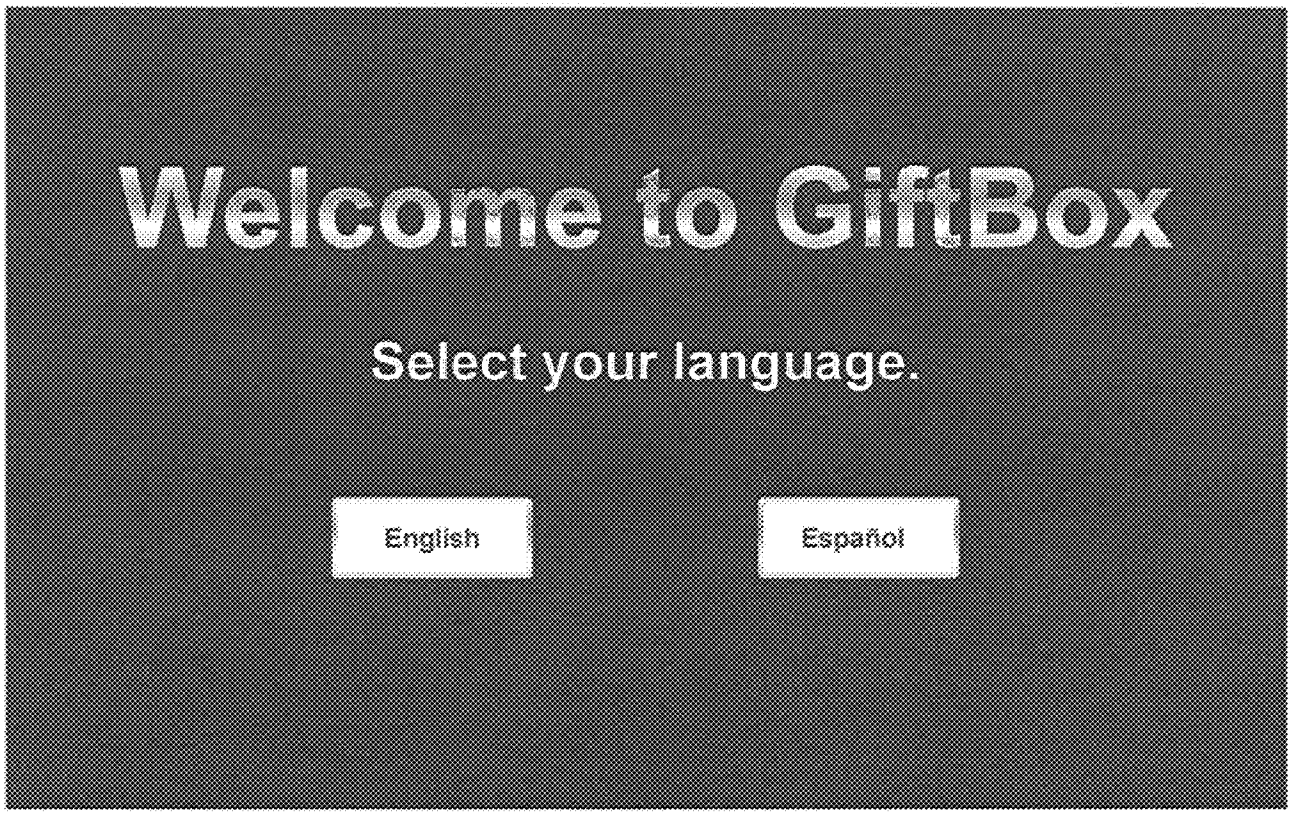
FIG. 9 is an example user interface associated with a vending apparatus for initiating contact with a user and allowing language selection, consistent with disclosed embodiments.
Figure 10:
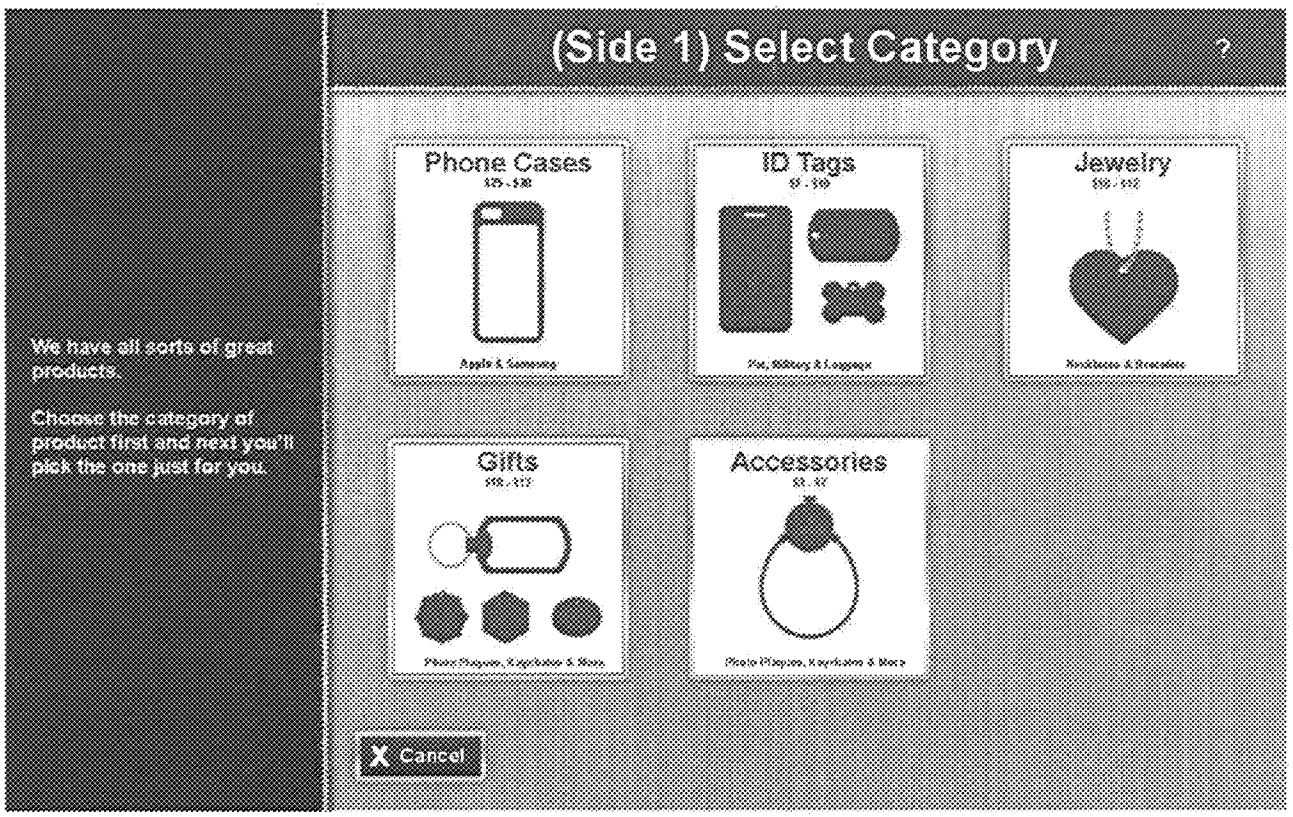
FIG. 10 is an example user interface associated with a vending apparatus for selecting one of a plurality of different types of products, consistent with disclosed embodiments.

FIGS. 9-14 are example graphical user interfaces (GUIs) that may be provided by the disclosed embodiments to facilitate interaction with a user. In these embodiments, user interface device 110 of a vending apparatus 100 may display the GUIs to the user via display screen 112. FIG. 9 is an example GUI that may be configured to initiate contact with a user and allowing language selection. FIG. 10 is an example GUI that may be configured to assist a user in selecting one of a plurality of different types of products to be purchased. Depending on the configuration of user interface device 110 and display screen 112, the different options illustrated as square boxes in FIG. 10 such as "Jewelry" and "Gifts" may be operable as touchscreen buttons, or may be selectable using an optional mouse/trackball and/or keyboard associated with user interface device 110.

Figure 11:
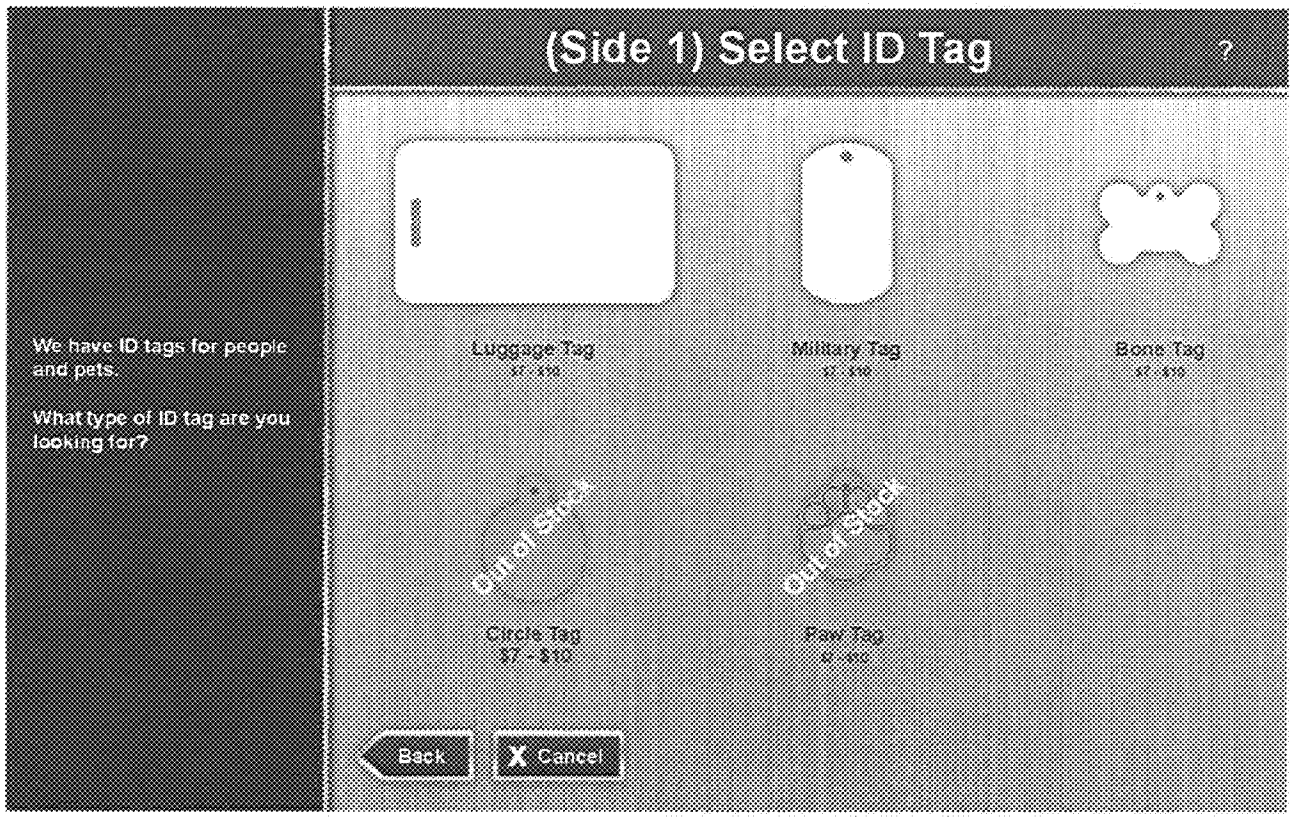
FIG. 11 is an example user interface associated with a vending apparatus for selecting one subtype of a plurality of different types of products, consistent with disclosed embodiments.

In FIG. 11, the user has chosen the option of "ID Tags" as a desired product to purchase via the GUI of FIG. 10, FIG. 11 is an example GUI that may be configured to assist a user in selecting a further subtype of the product. For example, the user is given the choice of a luggage tag, a military dog tag, or a bone-shaped pet tag. Different embodiments of vending apparatus 100 may display different options for selection based on the current configuration and inventory levels of one or more storage containers that may be associated with apparatus 100. For example, in the illustration of FIG. 11, circle tags and paw-shaped tags are displayed in a manner indicating to the user that they are "out of stock." In some embodiments, this display may indicate that vending apparatus 100 contains no storage containers configured to dispense these products, and thus they are not available at all for purchase via that particular vending apparatus 100. In other embodiments, storage containers configured to dispense the circle tags and paw tags may be present within inventory system 200 and vending apparatus 100, but end effector 50 may determine via sensor 806 as described above that the inventory for those items is depleted. Upon detection that a storage container associated with an item is empty, inventory system 200, via associated controls and/or computer systems, may initiate changes to the GUI shown to a user to indicate than an item is no longer available, as shown in FIG. 11. In some embodiments, when a user desires an out-of-stock product, user interface device 110 may be configured to automatically suggest a comparable product that is present within apparatus 100 with sufficient inventory.

Figure 12:
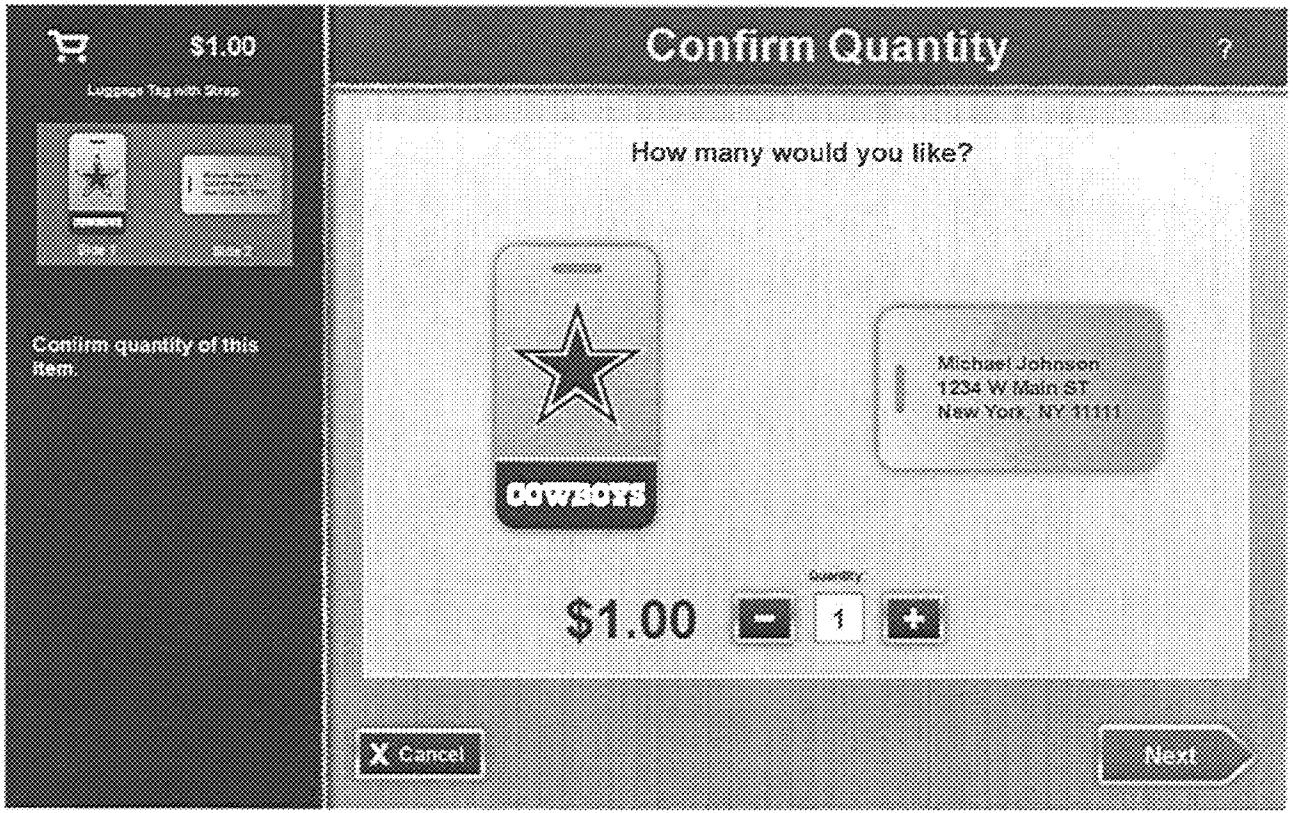
FIG. 12 is an example user interface associated with a vending apparatus for confirming quantities of customized products, consistent with disclosed embodiments.

FIG. 12 is an example GUI that may be configured to assist the user in confirming quantities and pricing of purchased products. Much in the manner described above in association with FIG. 11, inventory system 200 may be configured to provide information to user interface device 110 to assist in the configuration and presentation of the quantities shown in the GUI of FIG. 12. For example, if inventory system 200 determines that only four luggage tags remain in the storage container of vending apparatus 100, the GUI of FIG. 12 may not permit selection of a quantity more than four. Alternatively, if a quantity of more than four is desired, the GUI may be configured to display the locations of other nearby vending apparatuses 100, or may have the items produced at a remote location and shipped to the user. As discussed above, user interface device 110 may be configured to suggest a comparable alternative product should the desired quantity of a product not be available within a given vending apparatus 100. In some embodiments, user interface device 110 may be configured as discussed previously to provide discounts to the user based on the quantity of products ordered. For example, one luggage tag may be $1.00 as shown in FIG. 12, but three tags may be available at a discounted price of $2.50 instead of the unit price of $3.00.

Figure 13:
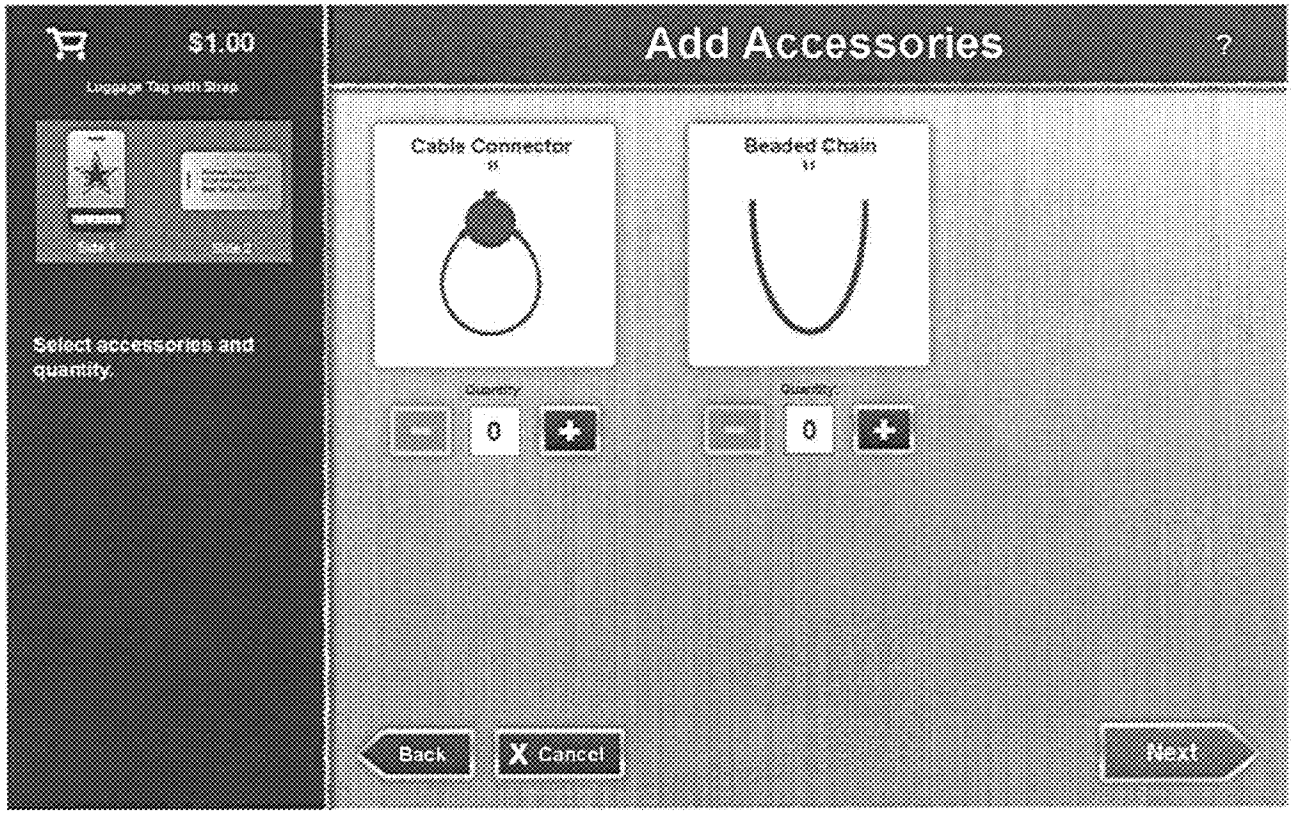
FIG. 13 is an example user interface associated with a vending apparatus for selecting optional accessories, consistent with disclosed embodiments.

FIG. 13 is an example GUI that may be configured to assist the user in selecting optional accessories to accompany a purchased product. In the example of FIG. 13, the product to be purchased is a luggage tag, so accessories presented to the user include a cable connector and/or a beaded chain for the tag. Different accessories may be displayed in the GUI for FIG. 13 depending on the product selected and based on the inventory of accessory storage containers within vending apparatus 100, as determined by inventory management system 200. Depending on the configuration of user interface device 110 and display screen 112, the different options illustrated as square boxes in FIG. 13 may be operable as touchscreen buttons, or may be selectable using an optional mouse/trackball and/or keyboard associated with user interface device 110.

Figure 14:
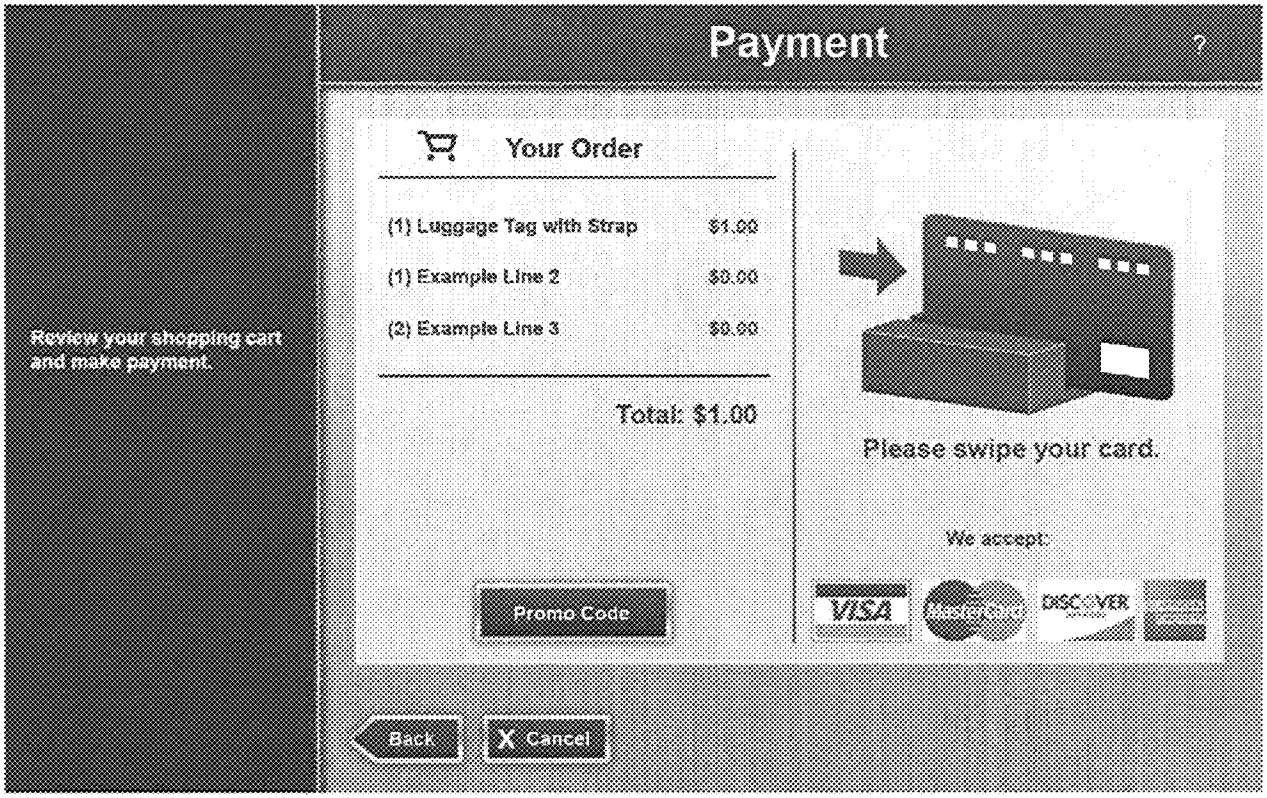
FIG. 14 is an example user interface associated with a vending apparatus for facilitating payment for one or more customized products, consistent with disclosed embodiments.

FIG. 14 is an example GUI that may be configured to facilitate payment for one or more purchased products and/or accompanying accessories. The GUI may be configured to show the purchased items to allow for review of the purchase by the user. The GUI may be further configured to allow the customer to remove purchases from the order, or to add additional purchases. In some embodiments, the GUI may be configured to assist the user in processing payment for the order, such as via credit card. The user may be prompted to additional details after swiping a credit card in a receptacle associated with user interface device 110 via the GUI of FIG. 14, or in embodiments where no such receptacle is present, the GUI may be configured to receive input of a credit card number and related information. As shown in FIG. 14, the system may be configured to receive additional information, such as a promotional code, customized message, or other information.

As configured, the systems and apparatuses contemplated by the disclosed embodiments allow merchants to more efficiently manage the inventory of a vending apparatus. The apparatus takes full advantage of digital and robotic technology, which streamlines monitoring and management of inventory and saves resources. For retail establishments, the apparatus presents a vast array of new products and market opportunities, with minimal inputs of labor, training, and management. Deployable in a wide range of embodiments, the apparatus can be individually configured and customized for the needs of a given user or application. Aspects of the apparatus design revolutionize the vending process, and allow faster, more productive marketing of vended products with fewer demands on retail and maintenance personnel.

Other embodiments of the invention will be apparent to those skilled in the art from consideration of the specification and practice of the invention disclosed herein. It is intended that the specification and examples be considered as examples only, with a true scope and spirit of the invention being indicated by the following claims.

What is claimed is:

1. An apparatus for displaying products for sale, comprising:

a wall with a plurality of holes drilled through it at predetermined intervals;

one or more storage containers configured to store a plurality of products;

fasteners sufficient to secure the one or more storage containers to the wall through the drilled holes; and wherein the one or more storage containers further comprise two or more pins configured to hold the products in place, wherein the pins are substantially perpendicular to the storage containers and the pins are oriented on the storage containers to account for a shape of the products, and wherein the one or more storage containers are marked with one or more indicia readable by at least one of a sensor or camera associated with a robot.

2. The apparatus of claim 1, wherein the width of each storage container corresponds to the predetermined interval between the drilled holes in the wall, or a multiple thereof.

3. The apparatus of claim 1, wherein one or more of the pins configured to hold the products in place is flexible or removable.

4. The apparatus of claim 3, wherein flexion or removal of the pins enables placement of products into the storage container from either the front or the top of the storage, container.

5. The apparatus of claim 1, wherein at least one of the one or more storage containers further comprises a shuttle permitting dispensing of a single product at a time from the storage container.

6. The apparatus of claim 5, wherein the shuttle is configured to interact with a component associated with the robot.

7. The apparatus of claim 1, wherein the indicia, when read by the robot, provide information to the robot comprising one or more of the size of the storage container, the type of product contained within the storage container, the price of the product, the number of products contained within the storage container, the maximum capacity of the storage container, or an entity associated with the product or apparatus.

8. A vending apparatus for facilitating sale of products in a retail environment, comprising:

a wall with a plurality of holes drilled through it at predetermined intervals;

one or more storage containers configured to store a plurality of products;

fasteners sufficient to secure the one or more storage containers to the wall through the drilled holes;

a robot comprising at least one of a camera or a sensor;

a delivery opening configured to provide a product to the user;

a housing substantially enclosing the wall, one or more storage containers, and robot; and a user interface device configured to facilitate payment by a consumer for a product stored within a storage container within the vending apparatus, wherein the one or more storage containers are marked with one or more indicia readable by the at least one camera or sensor associated with the robot, wherein the one or more storage containers further comprise two or more pins configured to hold the products in place, wherein the pins are substantially perpendicular to the storage containers and the pins are oriented on the storage containers to account for a shape of the products.

9. The vending apparatus of claim 8, wherein the robot comprises at least one end effector comprising a mechanical implement configured to interface with a storage container.

10. The vending apparatus of claim 9, wherein the at least one camera or sensor is located on the at least one end effector.

11. The vending apparatus of claim 8, wherein the sensor is a sensor selected from the group consisting of an infrared sensor, a laser sensor, a proximity sensor, a non-contact sensor, and a tactile sensor.

12. The vending apparatus of claim 8, wherein the user interface device is configured to transmit information to a remote server associated with one or more of a manufacturer of the vending apparatus, a retailer hosting the vending apparatus, or a third party.

13. The vending apparatus of claim 12, wherein the information is associated with the indicia on one or more storage containers, and comprises one or more of the size of the storage container, the type of product contained within the storage container, the current price of the product, the number of products contained within the storage container, the maximum capacity of the storage container, or an entity associated with the product or apparatus.

14. The vending apparatus of claim 13, wherein the apparatus is configured to compile a report comprising the information.

15. The vending apparatus of claim 14, wherein the apparatus is further configured to display the report to a user via the user interface device.

16. The vending apparatus of claim 8, wherein the apparatus is configured to alter information displayed to a user on the user interface device based on a determined count of inventory.

17. The vending apparatus of claim 16, wherein the alteration comprises one or more of an indication that a product is out of stock or an indication that only a certain quantity of products less than or equal to the determined count of inventory are available.

18. A method for managing inventory within a vending apparatus, comprising:

placing one or more storage containers containing a predetermined number of one or more types of items for sale within the vending apparatus;

configuring one or more indicia associated with each of the one or more storage containers readable by a camera or sensor associated with a robot;

determining an initial position of the predetermined number of items for sale within each of the one or more storage containers;

associating the determined initial positions with the configured indicia associated with each of the one or more storage containers;

reading, by the camera or sensor associated with the robot, each of the configured indicia associated with each of the one or more storage containers;

determining, by the camera or sensor associated with the robot, an updated position of the items for sale within each of the one or more storage containers;

determining at least one of a number of items for sale remaining or a number of items recently restocked within each of the one or more storage containers based on the determined initial position and determined updated position of the items for sale within the storage containers; and transmitting information relating to the vending apparatus to a remote server.

19. The method of claim 18, wherein the camera or sensor associated with the robot is a sensor, and the sensor is selecting from the group consisting of an infrared sensor and a laser sensor.

20. The method of claim 18, wherein determining, by the camera or sensor associated with the robot, an updated position of the items for sale within each of the one or more storage containers further comprises:

activating the camera or sensor;

aligning the camera or sensor with the determined initial position of a particular one of the one or more storage containers;

translating the robot until the camera or sensor detects a surface of an item for sale within the particular storage container;

storing information relating to the position of the detected surface of the item; and determining the distance traveled by the robot between the determined initial position and the detected surface of the item.

21. The method of claim 18, wherein the information relating to the vending apparatus transmitted to the remote server comprises one or more of the size of each of the one or more storage containers, the type of item for sale contained within each of the storage containers, the current price of the items for sale, the determined initial position of the predetermined number of items for sale within each of the storage containers, the determined updated position of the items for sale within each of the storage containers, the number of items for sale contained within each of the storage containers, the maximum capacity of each of the storage containers, or an entity associated with the items for sale or the vending apparatus.

22. The method of claim 21, wherein responsive to the transmission of the information to the remote server, one or more persons are dispatched to the location of the vending apparatus to refill one or more of the storage containers with a predetermined number of items for sale.

* * * * *